US009256157B2

(12) United States Patent
Tokudome et al.

(10) Patent No.: US 9,256,157 B2
(45) Date of Patent: Feb. 9, 2016

(54) MOVING MECHANISM FOR A DEVELOPING DEVICE, PROCESS CARTRIDGE AND IMAGE FORMING APPARATUS THAT REDUCES OR REMOVES PRESS-CONTACT FORCES ON A DEVELOPER CARRYING MEMBER

(71) Applicant: CANON KABUSHIKI KAISHA, Tokyo (JP)

(72) Inventors: Makoto Tokudome, Yokohama (JP); Daisuke Baba, Mishima (JP); Yuichiro Hirata, Boise, ID (US); Norihito Naito, Numazu (JP); Kodai Hayashi, Suntou-gun (JP); Masao Uyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/927,194

(22) Filed: Jun. 26, 2013

(65) Prior Publication Data

US 2014/0003845 A1 Jan. 2, 2014

(30) Foreign Application Priority Data

Jun. 28, 2012 (JP) ..... 2012-145573

(51) Int. Cl.
*G03G 15/08* (2006.01)
*G03G 21/18* (2006.01)

(52) U.S. Cl.
CPC ..... *G03G 15/0812* (2013.01)

(58) Field of Classification Search
CPC ..... G03G 15/0812
USPC ..... 399/227, 228, 284
See application file for complete search history.

(56) References Cited

U.S. PATENT DOCUMENTS 6,496,664 B1 12/2002 Ogata et al.
6,661,980 B2 12/2003 Matsumoto et al.

(Continued)

FOREIGN PATENT DOCUMENTS

JP 03-024571 1/1991
JP 09-211957 8/1997

(Continued)

*Primary Examiner* — Clayton E Laballe
*Assistant Examiner* — Peter L Cheng
(74) *Attorney, Agent, or Firm* — Fitzpatrick, Cella, Harper & Scinto

(57) ABSTRACT

A developing apparatus includes a developing container for accommodating a developer; a developer carrying member for carrying the developer to a developing zone for developing a latent image; a developer regulator in contact with the developer carrying member to regulate a developer layer thickness on the developer carrying member; a developer feeding member in contact with the developer carrying member to supply the developer to the developer carrying member; an urging member for urging the developer carrying member toward the developer regulator; and a moving mechanism for moving the developer carrying member in a first direction which is a direction in which the urging member urges the developer carrying member and in a second direction crossing with the first direction. The moving mechanism moves the developer carrying member in the second direction to reduce or remove press-contact forces applied by the developer regulator and the developer feeding member.

18 Claims, 13 Drawing Sheets

(56) References Cited

U.S. PATENT DOCUMENTS

| | | | |
|---|---|---|---|
| 6,785,479 | B2 | 8/2004 | Naito et al. |
| 6,834,175 | B2 | 12/2004 | Murayama et al. |
| 6,922,539 | B2 | 7/2005 | Uyama et al. |
| 6,947,678 | B2 | 9/2005 | Ohtomo et al. |
| 6,963,714 | B2 | 11/2005 | Otomo et al. |
| 6,978,099 | B2 | 12/2005 | Ueno et al. |
| 7,639,956 | B2 | 12/2009 | Naito et al. |
| 7,692,804 | B2 | 4/2010 | Naito et al. |
| 8,095,035 | B2 * | 1/2012 | Ooyoshi ..... G03G 21/1821 399/111 |

FOREIGN PATENT DOCUMENTS

| | | | |
|---|---|---|---|
| JP | 11-231643 | | 8/1999 |
| JP | 2002-328525 | * | 11/2002 |
| JP | 2002-333772 | * | 11/2002 |
| JP | 2002328525 A | | 11/2002 |
| JP | 2008-304797 | * | 12/2008 |
| JP | 2008304797 A | | 12/2008 |

* cited by examiner

MOVING MECHANISM FOR A DEVELOPING DEVICE, PROCESS CARTRIDGE AND IMAGE FORMING APPARATUS THAT REDUCES OR REMOVES PRESS-CONTACT FORCES ON A DEVELOPER CARRYING MEMBER

FIELD OF THE INVENTION AND RELATED ART

The present invention relates to a developing device which uses developer to develop a latent image formed on an image bearing member. It is also related to a process cartridge and an image forming apparatus, which are equipped with a developing device in accordance with the present invention.

An image bearing member is a member on which a latent image can be formed. As examples of an image bearing member, there are an electrophotographic photosensitive member used by an electrophotographic image forming method, a dielectric member on which an image is electrostatically recordable, a magnetic member on which an image is magnetically recordable with the use of a magnetic recording method, and the like.

A process cartridge is a cartridge in which at least an image bearing member and a developing device are placed together so that they can be removably installed in the process cartridge chamber of the main assembly of an image forming apparatus.

Roughly speaking, image forming apparatuses may be classified into two types, that is, the direct type and indirect type. An image forming apparatus of the direct transfer type forms a visible image (image formed of developer) on its image bearing member, transfers the visible image from the image bearing member onto a sheet of recording medium directly from the image bearing member, and outputs the sheet of recording medium as a finished print. In comparison, an image forming apparatus of the indirect type forms a visible image (image formed of developer) on its image bearing member, transfers the visible image onto its intermediary transferring member from the image bearing member, and then, transfers the visible image onto a sheet of recording medium from the intermediary transfer belt. Then, it outputs the sheet of recording medium as a finished print. There are also image forming apparatuses which directly form a visible image on a sheet of photosensitive paper or electrostatic recording paper, fixes the visible image, and outputs the sheet as a finished print. Further, there are image displaying apparatuses, such as an electronic black or white board which form a visible image (image formed of developer) on its image bearing member, and then, displays the visible image on its image displaying device (display).

To begin with, an example of an electrophotographic image forming apparatus such as a copying machine, a laser beam printer, and the like is described with reference to the above-mentioned image forming apparatuses. These types of image forming apparatus form an electrostatic image (latent image) on an electrophotographic photosensitive member (which hereafter may be referred to simply as photosensitive member) by scanning the uniformly charged portion of the peripheral surface of their photosensitive member, with a beam of light emitted by their scanning (exposing device) while being modulated according to the data of an image to be formed. Then, they develop the electrostatic image into a visible image, that is, an image formed of toner, by providing the electrostatic image with the toner (developer), as recording material, from their developing device. Then, they transfer the visible image (image formed of toner (which hereafter will be referred to simply as toner image) from the photosensitive member onto a sheet of recording medium such as recording paper. Then, they fix the toner image to the sheet of recording medium with the use of their fixing device, to output a permanent image (print).

There have been proposed various developing devices (apparatuses) which use developer. Most of them are equipped with a development roller, which opposes a photosensitive member, and a toner supply roller which opposes the development roller. In these developing devices, the toner held to the peripheral surface of the toner supply roller is supplied to the peripheral surface of the development roller. After being supplied to the peripheral surface of the development roller, the toner is formed into a toner layer which is uniform in thickness (preset amount per unit area) by a blade (regulation blade) for forming the toner on the peripheral surface of the development roller into a uniform layer of toner with a preset thickness, while charging the toner to the preset polarity. The charged toner on the development roller is supplied to the photosensitive member, in the development area, in which the peripheral surface of the development roller opposes the peripheral surface of the photosensitive member. The toner which is remaining on the development roller on the downstream side of the development area, in terms of the moving direction of the peripheral surface of the development roller, that is, the toner which was not supplied to the photosensitive member, is recovered by the toner supply roller.

In a developing device such as the one described above, the development roller remains continuously pressed by the regulation blade. Therefore, if the developing device is kept unused for a substantial length of time, the portion of the development roller, which is remaining pressed by the regulation blade, is irreversibly deformed. Further, the toner supply roller is kept pressed upon the development roller. Therefor, a certain amount of contact pressure is always present between the peripheral surface of toner supply roller and the peripheral surface of the development roller. Consequently, the toner supply roller is irreversibly deformed by the development roller.

There have been proposed various devices for preventing the aforementioned irreversible deformations. For example, Japanese Laid-open Patent Application H03-24571 discloses a developing device equipped with a contact pressure controlling means for eliminating or reducing the contact pressure between the regulation blade and development roller during a period in which the developing device is not in operation, to prevent the development roller from being irreversibly deformed by the regulation blade while the developing device is not in operation.

Japanese Laid-open Patent Application H09-211957 discloses a developing device equipped with a contact pressure changing means for continuously, or in steps, changing the contact pressure between the development roller and toner supply roller, based on the ambient temperature and humidity detected by the temperature/humidity detecting means. With the employment of this structural arrangement, the toner supply roller is kept pressed upon the development roller in such a manner that the contact pressure between the two rollers does not become unnecessarily high. Therefore, even after the repetition of a substantial number of printing operations, the image forming apparatus equipped with this developing device continues to output satisfactory images.

However, in order for a developing device to be capable of preventing both the irreversible deformation of the development roller attributable to the contact pressure between the regulation blade and development roller, and the irreversible deformation of the toner supply roller attributable to the contact pressure between the toner supply roller and development roller, the developing device requires both the above described contact pressure controlling means and contact pressure changing means. Providing a developing device with both the above described means makes the device excessively complicated in structure.

SUMMARY OF THE INVENTION

The present invention was made in consideration of the above described problem. Therefore, its primary object is to provide a developing device capable of preventing its developer bearing member and developer supply member from being irreversibly deformed, and yet, is simple in structure, and also, to provide a process cartridge and an image forming apparatus, which are equipped with a developing device which is in accordance with the present invention.

According to an aspect of the present invention, there is provided a developing apparatus for developing a latent image formed on an image bearing member, comprising a developing container for accommodating the developer; a rotatable developer carrying member for carrying the developer to a developing zone for developing the latent image; a developer regulating portion contacted to said developer carrying member to regulate a thickness of a layer of the developer carried on said developer carrying member to a predetermined thickness; a developer feeding member contacted to said developer carrying member to supply the developer to said developer carrying member; an urging member for urging said developer carrying member toward said developer regulating portion; and a moving mechanism for moving said developer carrying member in a first direction which is a direction in which said urging member urges said developer carrying member and in a second direction crossing with the first direction, wherein said moving mechanism moves said developer carrying member in the second direction to reduce or remove press-contact forces applied by said developer regulating portion and said developer feeding member.

According to another aspect of the present invention, there is provided a process cartridge detachably mountable to an assembly of an image forming apparatus, said process cartridge comprising an image bearing member for bearing a latent image; a developing container for accommodating a developer; a rotatable developer carrying member for carrying the developer to a developing zone for developing the latent image; a developer regulating portion contacted to said developer carrying member to regulate a thickness of a layer of the developer carried on said developer carrying member to a predetermined thickness; a developer feeding member contacted to said developer carrying member to supply the developer to said developer carrying member; an urging member for urging said developer carrying member toward said developer regulating portion; and a moving mechanism for moving said developer carrying member in a first direction which is a direction in which said urging member urges said developer carrying member and in a second direction crossing with the first direction, wherein said moving mechanism moves said developer carrying member in the second direction to reduce or remove press-contact forces applied by said developer regulating portion and said developer feeding member.

According to a further aspect of the present invention, there is provided an image forming apparatus for forming an image on a recording material, said image forming apparatus comprising an image bearing member for bearing a latent image; a developing container for accommodating a developer; a rotatable developer carrying member for carrying the developer to a developing zone for developing the latent image; a developer regulating portion contacted to said developer carrying member to regulate a thickness of a layer of the developer carried on said developer carrying member to a predetermined thickness; a developer feeding member contacted to said developer carrying member to supply the developer to said developer carrying member; an urging member for urging said developer carrying member toward said developer regulating portion; and a moving mechanism for moving said developer carrying member in a first direction which is a direction in which said urging member urges said developer carrying member and in a second direction crossing with the first direction, wherein said moving mechanism moves said developer carrying member in the second direction to reduce or remove press-contact forces applied by said developer regulating portion and said developer feeding member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Before starting to explain embodiments of the present invention, a couple of referential image forming apparatuses to which the present invention is applicable are described. Then, one of the embodiments of the present invention is described with reference to these referential image forming apparatuses.

The dimension, materials, shapes of the structural components of the referential image forming apparatuses, and the positional relationship among the structural components, are not intended to limit the present invention in terms of the type of an image forming apparatus to which the present invention is applicable. That is, the present invention is applicable to the referential image forming apparatus even if they are modified according to the structural requirement, various conditions under which they are used, and/or the like factors.

Incidentally, regarding the structures and operations of the process cartridges in this specification of the present invention, the terms such as "top, bottom, right and left" which indicate the direction means the directions when the process cartridges are in the normal attitude unless specifically noted. That is, the normal attitude in which the process cartridges are used is such an attitude in which the process cartridges are after they have been properly installed in a properly positioned image forming apparatus so that they can be used for image formation.

[First Referential Image Forming Apparatus]

<Image Formation Station>

Figure 2:
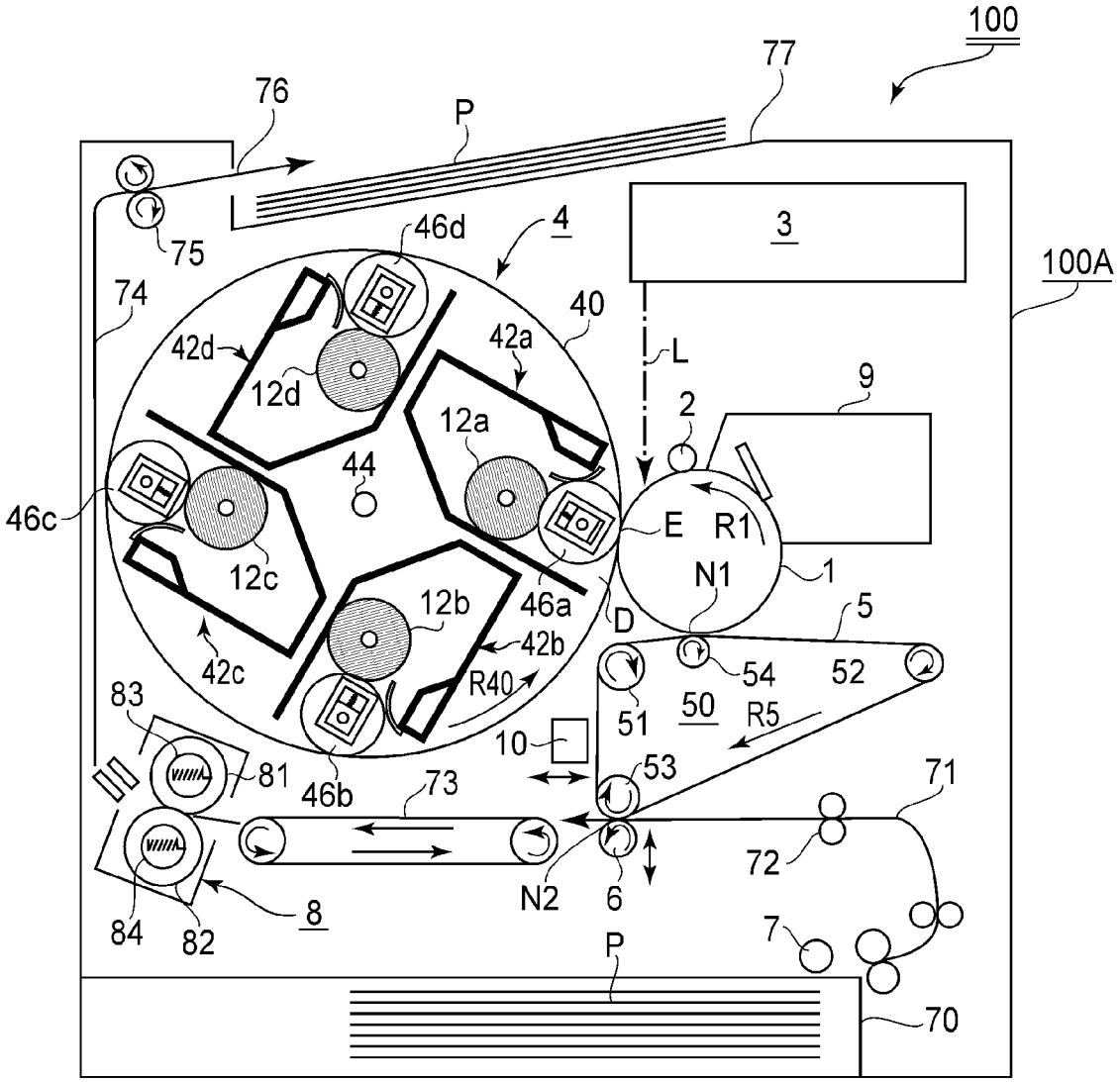
FIG. 2 is a schematic sectional view of the first referential multicolor image forming apparatus to which the present invention is applicable, and shows the general structure of the apparatus.

FIG. 2 is a schematic sectional view of a multicolor image forming apparatus 100 which uses an electrophotographic process, that is, an image formation process with which the present invention is concerned. The image forming apparatus 100 is a laser beam printer which uses an electrophotographic process. That is, it can form, on a sheet of recording medium, a multicolor (full-color) image, or a monochromatic image, according to electrical information of the image to be formed, which is inputted into the control circuit (unshown controlling means) of the image forming apparatus 100 from a host apparatus (unshown) such as a personal computer, an image reader, and the like. First, the structure and operation of this multicolor image forming apparatus 100 are described following the image formation process.

The image forming apparatus 100 is provided with an electrophotographic photosensitive member 1 (which will be referred to simply as drum, hereafter), which is in the form of a rotatable drum. The drum 1 is positioned in the main assembly 100A (which will be referred to simply as apparatus main assembly 100A) of the apparatus 100. The drum 1 is rotatably supported by a shaft (unshown) attached to the frame of the apparatus main assembly 100A. It is rotationally driven by a drum driving mechanism (unshown) in the counterclockwise direction indicated by an arrow mark R1 at a preset peripheral velocity (process speed).

As the drum 1 is rotated, its peripheral surface is uniformly charged by a charge roller 2 to preset polarity and potential level. Then, the uniformly charged portion of the peripheral surface of the drum 1 is subjected to a beam L of laser light projected from an exposing device 3 while being modulated with image formation signals; it is scanned by (exposed to) the beam L of laser light. Consequently, an electrostatic latent image, which reflects the image formation signals, is effected upon the peripheral surface of the drum 1.

The image forming apparatus 100 is provided with a rotary developing device 4, which is positioned in the roughly center portion of the apparatus main assembly 100A. The rotary developing device 4 has a rotary 40, which is cylindrical and is rotatable about the rotary supporting shaft 44 of the rotary developing device 4. The rotary 40 is rotatable about the shaft 44 by a rotary driving mechanism (unshown) in the counterclockwise direction indicated by an arrow mark R40. It can be stopped (positioned) at four different angular positions (attitudes) in terms of its rotational direction, which are 90 degrees apart from the adjacent positions. The rotary developing device 4 is provided with four developing devices 42 (42*a*, 42*b*, 42*c* and 42*d*) for developing an electrostatic latent image formed on the drum 1. The developing devices 42 are positioned in the rotary 40, and are removably supported by the rotary 40, in such a manner that they are 90 degrees apart from their adjacent developing devices 42, in terms of the rotational direction of the rotary 40.

The four developing devices 42 which are for developing a latent image on the drum 1, with the use of developer, are the same in structure, although they are different in the color of the toner, as developer, they store. The detailed description of the developing devices 42 will be given later. In this referential image forming apparatus, the developing devices 42*a*, 42*b*, 42*c*, and 42*d* store yellow (Y), magenta (M), cyan (C) and black (K) toners, respectively.

Each developing device 42 is provided with a development roller 46 (46*a*, 46*b*, 46*c* or 46*d*) as a developer bearing member. The development roller 46 can be positioned in the development position D, or home position (in which it is kept when it is not used for development). When the development roller 46 is in the development position D, a part of its peripheries remains protruding outward from the rotary 40 in the radius direction of the rotary 40, by 2 mm.

The rotary developing device 4 is structured so that each developing device 42 can be moved into the development position D, in which the developing device 42 opposes the drum 1, by rotating the rotary 40 by a preset angle (control angle), and can be held in the development position D. As a given developing device 42 is moved into the development position D, its development roller 46 is placed in contact with the drum 1 in such a manner that a preset amount of contact pressure is generated between the development roller 46 and drum 1. That is, the rotary 40 functions as a mechanism for placing each of the development roller 46 in contact with the drum 1, or separating each of the development roller 46 from the drum 1.

As the development roller 46 is placed in contact with the drum 1, that is, as the developing device 42 is moved into the development position D, the developing device 42 begins to be driven with a preset control timing (during development process), and bias for developing the electrostatic latent image on the photosensitive drum 1 (bias for adhering preset amount of toner to electrostatic image, per exposed point of electrostatic image) begins to be applied to the development roller 46. Thus, the electrostatic latent image on the drum 1 is developed into a visible image, which is an image formed of toner (toner image, i.e.). Then, the toner image is transferred (primary transfer) onto the surface of the intermediary transfer member 5 of the intermediary transfer unit 50; four toner images, different in color, formed on the development rollers 46*a*, 46*b*, 46*c* and 46*d*, one for one, are sequentially transferred in layers (primary transfer) onto the intermediary transfer member 5. The toner remaining on the peripheral surface of the drum 1 after the primary transfer, that is, the toner on the peripheral surface of the drum 1, which was not transferred onto the intermediary transfer member 5, is removed from the peripheral surface of the drum 1 by the drum cleaning device 9, so that the drum 1 can be repeatedly used for image formation.

This referential image forming apparatus to which the present invention is applicable uses an endless and flexible belt 5 (which will be referred to simply as belt) as the intermediary transfer member 5 of its intermediary transfer unit 50. The belt 5 is suspended and kept stretched by four rollers, more specifically, a belt driving roller 51 (driver roller, hereafter), a tension roller 52, a belt backing roller 53 (which opposes secondary transfer roller), and a primary transfer roller 54, which are positioned in parallel to each other. The primary transfer roller 54 is kept pressed against the drum 1 with the placement of the belt 5 between itself and drum 1. The belt 5 is in contact with the peripheral surface of the drum 1, forming thereby the primary transfer area which has a preset dimension (width) in terms of the moving direction of the belt 5. In other words, the area of contact between the belt 5 and photosensitive drum 1 is the primary transfer station N1. As the driver roller 51 is rotationally driven, the belt 5 is circularly moved in the clockwise direction indicated by an arrow mark R5 at roughly the same speed as the peripheral velocity of the drum 1.

The belt backing roller 53 is positioned so that it opposes the secondary transfer roller 6 with the presence of the belt 5 between itself and secondary transfer roller 6. The image forming apparatus 100 is structured so that the secondary transfer roller 6 can be changed in position by a secondary transfer shifting mechanism (unshown) so that it can be positioned in its operational position in which it is kept pressed against the belt backing roller 53 with the presence of the belt 5 between itself and belt backing roller 53, and its non-operational position in which it is kept separated from the belt 5. When an image is not transferred onto a sheet of recording medium, the secondary transfer roller 6 is in its non-operational position. It is moved with a preset control timing (secondary transfer timing) into its operational position in which it is kept in contact with the belt 5. The area of contact between the secondary transfer roller 6 and belt 5 is the secondary transfer station N2.

Further, the image forming apparatus 100 is provided with a belt cleaning device 10, which is positioned between the driver roller 51 and belt backing roller 53 in terms of the moving direction of the belt 5, in such a manner that it opposes the outward surface of the belt 5 with reference to the loop which the belt 5 forms. The developing device 42 is structured so that the belt cleaning device 10 can be positioned by a cleaning device moving mechanism (unshown), in its operational position in which the cleaning member (unshown) of the cleaning device 10 is kept in contact with the belt 5, and its nonoperational position in which the cleaning member is kept separated from the belt 5. When the cleaning device 10 is not in use, it is kept in its nonoperational position. It is moved into its operational position with a preset control timing (belt cleaning timing) to clean the belt 5.

The operational sequence of the image forming apparatus 100 through which a multicolor image is formed is as follows: First, an electrostatic latent image which corresponds to the yellow (Y) color component of the image to be formed is formed on the peripheral surface of the drum 1. As this electrostatic latent image is formed, the developing device 42*a* is moved into the development position D, and begins to be driven. Thus, the electrostatic latent image on the drum 1 is developed into a yellow (Y) monochromatic image, which is a monochromatic image formed of yellow (Y) toner. Then, the yellow (Y) monochromatic toner image is transferred (primary transfer) onto the belt 5, in the primary transfer station N1. During the transfer (primary transfer) of the yellow (Y) toner image from the drum 1 onto the belt 5, a preset primary transfer bias is applied to the primary transfer roller 54 from an electric power source (unshown).

Next, an electrostatic latent image which corresponds to the magenta (M) color component of the image to be formed is formed on the peripheral surface of the drum 1. As this electrostatic latent image is formed, the developing device 42*b* is moved into the development position D, and begins to be driven. Thus, the electrostatic latent image on the drum 1 is developed into a magenta (M) monochromatic image, which is a monochromatic image formed of magenta (M) toner. Then, the magenta (M) monochromatic toner image is transferred (primary transfer) onto the belt 5, in the primary transfer station N1, in such a manner that it is layered on the yellow (Y) toner image on the belt 5.

Next, an electrostatic latent image which corresponds to the cyan (C) color component of the image to be formed is formed on the peripheral surface of the drum 1. As this electrostatic latent image is formed, the developing device 42*c* is moved into the development position D, and begins to be driven. Thus, the electrostatic latent image on the drum 1 is developed into a cyan (C) monochromatic image, which is a monochromatic image formed of cyan (C) toner. Then, the cyan (C) monochromatic toner image is transferred (primary transfer) onto the belt 5, in the primary transfer station N1, in such a manner that it is layered on the yellow (Y) and magenta (M) toner images on the belt 5.

Then, an electrostatic latent image which corresponds to the black (K) color component of the image to be formed is formed on the peripheral surface of the drum 1. As this electrostatic is formed, the developing device 42*d* is moved into the development position D, and begins to be driven. Thus, the electrostatic latent image on the drum 1 is developed into a black (K) monochromatic image, which is a monochromatic image formed of black (K) toner. Then, the black (K) monochromatic toner image is transferred (primary transfer) onto the belt 5, in the primary transfer station N1, in such a manner that it is layered on the yellow (Y), magenta (M) and cyan (C) toner images on the belt 5.

Consequently, four unfixed monochromatic toner images, more specifically, unfixed yellow (Y), magenta (M), cyan (C) and black (K) monochromatic toner images, are layered on the belt 5, effecting thereby a single unfixed multicolor toner image. While the four monochromatic toner images, different in color, are layered on the belt 5, the secondary transfer roller 6 and belt cleaning device 10 are kept in their nonoperational positions, in order not to disturb the unfixed toner images on the belt 5. Then, they are moved into their operational positions with preset control timings while the unfixed multicolor toner image, or the combination of the four monochromatic toner images, different in color, layered on the belt 5, is moved to the secondary transfer roller 53.

Meanwhile, the multiple sheets P of recording medium (transfer medium) stored in layers in a sheet feeder cassette 70 in the apparatus main assembly 100A are fed one by one into the apparatus main assembly 100A with preset control timing by a sheet feeder roller 7 while being separated from the rest in the cassette 70. Then, each sheet P of recording medium is introduced into the secondary transfer station N2 with a preset control timing, through a recording medium conveyance passage 71 which includes a pair of registration rollers 72.

The pair of registration rollers 72 conveys the sheet P of recording medium with such a timing that the sheet P reaches the secondary transfer station N2 at the same time as the leading edge of the multicolor image, which is made up of the layered four monochromatic images, different in color, on the belt 5. Thus, the four monochromatic toner images, different in color, on the belt 5 are transferred together (secondary transfer) onto the sheet P from the belt 5, in the secondary transfer station N2, as if they are peeled away from the belt 5. During the secondary transfer of the toner images from the belt 5 onto the sheet P, a preset secondary transfer bias is applied to the secondary transfer roller 6 from an electric power source (unshown).

As the sheet P is conveyed out of the secondary transfer station N2, it separates from the belt 5, is conveyed to the fixing device 8 by the recording medium conveying device 73 of the belt type, and is conveyed through the fixing device 8. While the sheet P is conveyed through the fixing device 8, the sheet P and the toner images thereon are subjected to heat and pressure by the fixing device 8. Consequently, the unfixed four layers of monochromatic toner images, different in color, on the sheet P become permanently fixed to the sheet P. After the separation of the sheet P from the belt 5, the surface of the belt 5, on which the four monochromatic toner images, different in color, were layered, is cleaned by the belt cleaning device 10, which has been moved into its operational position; the unwanted adhesive contaminants such as the toner remaining on the belt 5 after the secondary transfer, paper dust, etc., are removed by the belt cleaning device 10. The belt cleaning device 10 is moved back into its nonoperational position with preset control timing, after the trailing edge of the sheet P comes out of the secondary transfer station N2.

The fixing device 8 of this referential image forming apparatus is such a fixing device that fixes an unfixed toner image with the application of heat and pressure to a sheet P of recording medium and the toner image thereon. It has a pair of heat rollers 81 and 82, the area of contact between which is the fixation nip, through which the sheet P is conveyed while remaining pinched by the heat rollers 81 and 82. The heat rollers 81 and 82 are provided with internal heaters 83 and 84, respectively, being thereby heated from within themselves so that their surface temperature remains at a preset level. After being conveyed through the fixing device 8, the sheet P is conveyed further through the recording medium conveyance passage 74. Then, it is discharged as a multicolor print through the outlet 76 by a pair of discharge roller 75, into the delivery tray 77 which is a part of the top wall of the image forming apparatus 100.

In the case of this referential image forming apparatus, the drum 1 is a negatively chargeable organic photosensitive member, which is 30 mm in diameter. The charge roller 2 is 12 mm in diameter. To the charge roller 2, a combination of DC voltage (−600 V), and AC voltage which is 1.6 kVpp in peak-to-peak voltage, and 1.2 kHz in frequency, is applied during the charging of the peripheral surface of the drum 1. As the uniformly charged portion of the peripheral surface of the drum 1 is scanned by (exposed to) the beam of laser light projected by the exposing device 3, the exposed points of the uniformly charged portion of the peripheral surface of the drum 1 reduce in potential to roughly −150 V. During the development of the electrostatic latent image on the drum 1, bias which is a combination of DC voltage (−350 V), and AC voltage which is 2.0 kVpp in peak-to-peak voltage, and 2.0 kHz in frequency, is applied to the developing device 42.

The belt 5 is 440 mm in circumference. It is an endless and flexible belt. It is made up of a base layer (bottom layer) and a top layer. The base layer is made of rubber (epichlorohydrin rubber), and is 0.7 mm. It has been adjusted in volume resistivity to roughly 105Ω·cm. The top layer is a separation layer. It is 20 μm in thickness, and is formed of fluorinated resin.

In order to transfer a toner image (yellow, magenta, cyan or black toner image) on the drum onto the belt 5, bias (+200 V, +500 V, +500 V and +600 V, respectively) are applied to the primary transfer roller 54. The secondary transfer roller 6 is a roller made of foamed EPDM, which has been adjusted in volume resistivity to roughly 107Ω·cm. It is 20 mm in diameter. During the transfer (secondary transfer) of the toner image(s) on the belt 5 onto a sheet P of recording medium, roughly 2.0 kV of bias is applied to the secondary transfer roller 6.

The pair of rollers 81 and 82 of the fixing device 8 are made of silicone rubber, and are kept at 180° C. in temperature by the internal heaters 82 and 84 with which the rollers 81 and 82 are provided, respectively.

By the way, the order in which the four monochromatic toner images, different in color, are formed on the drum 1 does not need to be limited to the order in which they are formed by this referential image forming apparatus. That is, it is optional. Further, when a monochromatic image of a specific color is to be formed, the developing device 42 which contains the toner of the specific color is moved into the development position D to be used for development.

<Developing Device (Developing Apparatus)>

(1) Overall Structure of Developing Device 42 (Developing Apparatus)

In the following description of the developing device 42 (developing apparatus), the "front surface side" of the developing device 42 is where the development roller 46 as a developer bearing member opposes the drum 1 as an image bearing member. The "operator side", "front side" and "front" also means the front surface side of the developing device 42. The "rear surface side" of the developing device 42 is the opposite surface side from the "front surface side". The "rear side" and "back side" are the same in meaning as the "rear surface side". The "left and right" of the developing device 42 are the left and right as seen from the front side of the device 42. The "top and bottom sides" of the device 42 are with reference to the direction of the gravity. The lengthwise direction of the device 42 is the direction parallel to the axial line of rotatable members of the device 42, or direction parallel to the axial line of the rotatable members.

Figure 3:
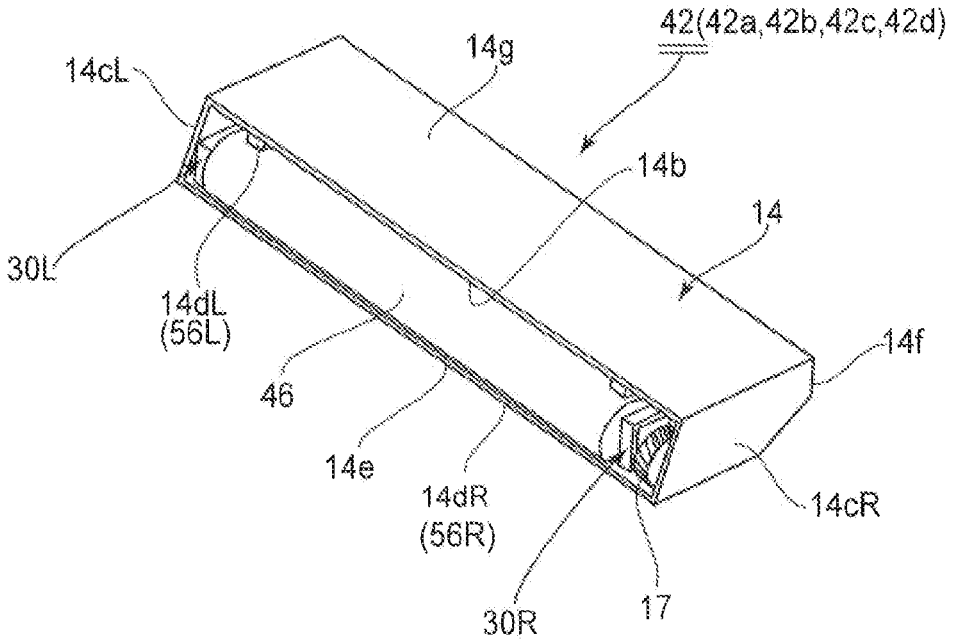
FIG. 3 is an external perspective view of one of the developing devices of the first referential image forming apparatus.
Figure 4:
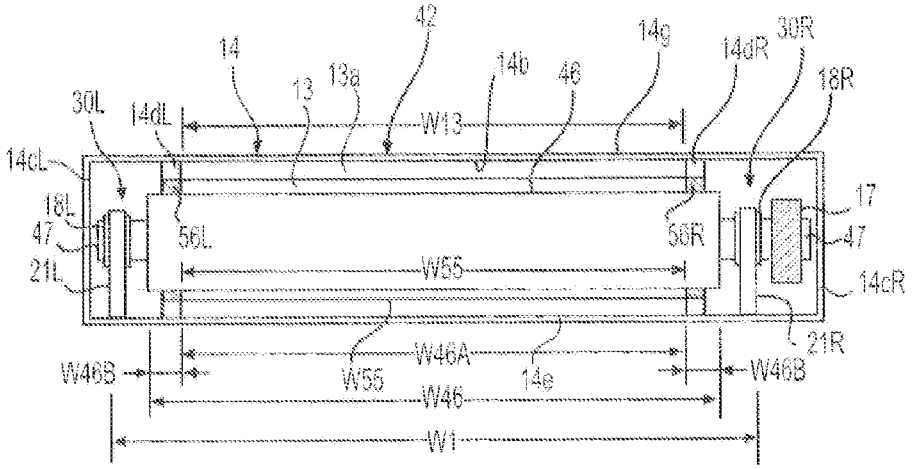
FIG. 4 is a front view of the developing device shown in FIG. 3.
Figure 5:
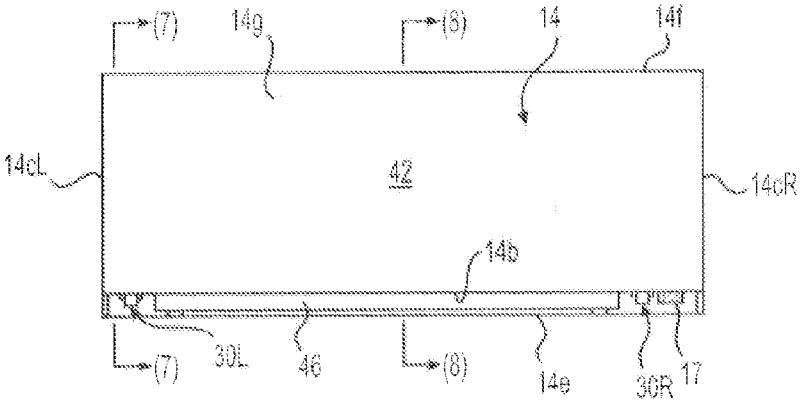
FIG. 5 is a plan view of the developing device shown in FIG. 3.
Figure 6:
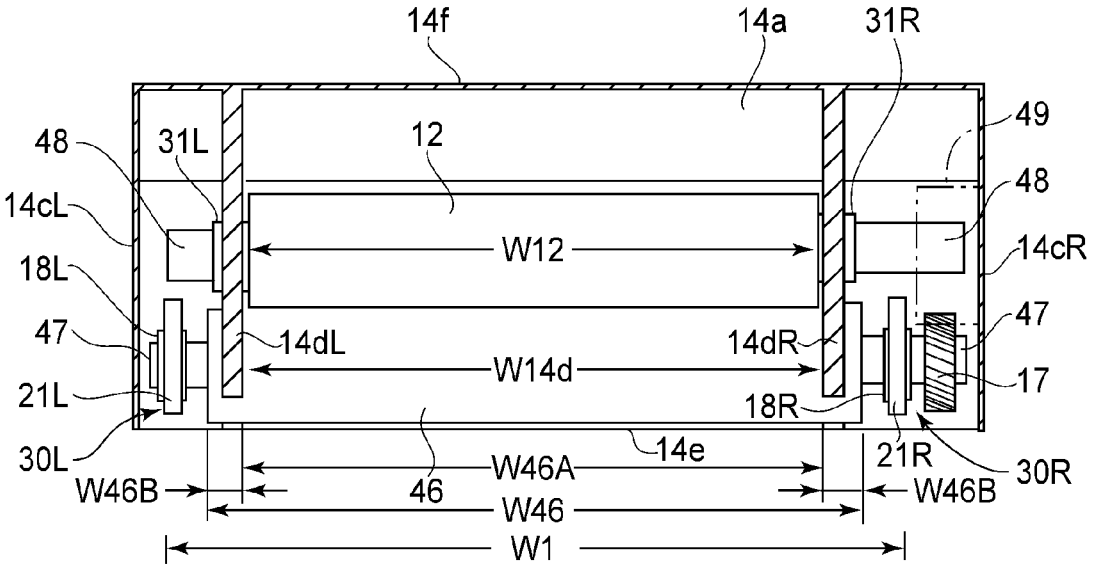
FIG. 6 is a plan view of the developing device shown in FIG. 5, minus the top plate (wall) of the frame of the device, and the development blade of the device.
Figure 7:
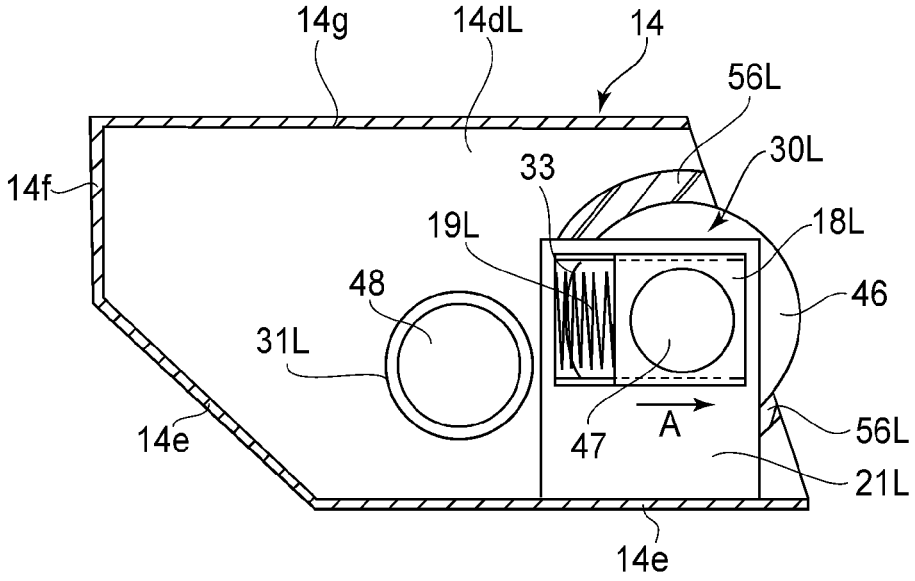
FIG. 7 is an enlarged sectional view of the developing device shown in FIG. 3, at a plane (7)-(7) indicated by arrow marks in FIG. 5.
Figure 8:
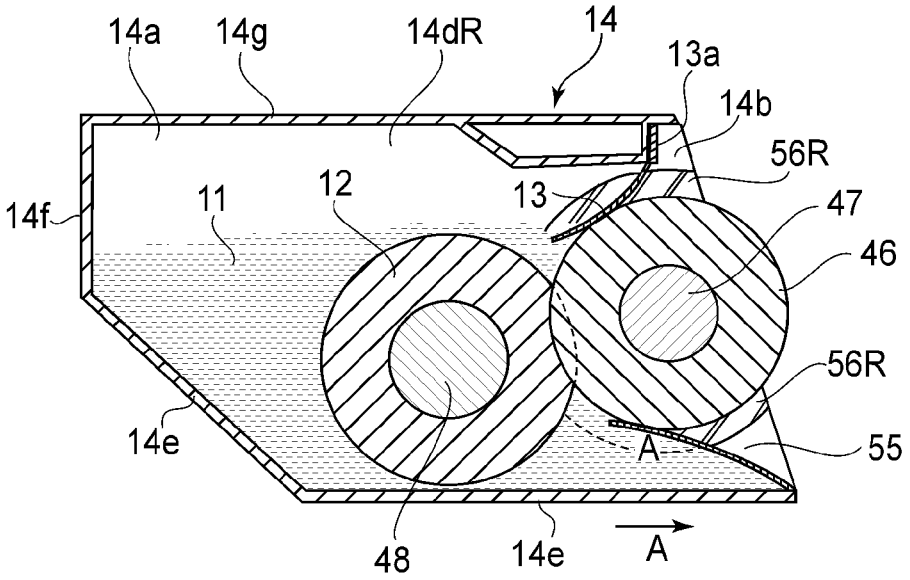
FIG. 8 is an enlarged sectional view of the developing device shown in FIG. 3, at a plane (8)-(8) indicated by arrow marks in FIG. 5.

FIG. 3 is an external perspective view of the developing device 42 of this referential image forming apparatus, and FIG. 4 is a front view of the developing device 42 shown in FIG. 3. FIG. 5 is a plan view of the developing device 42 shown in FIG. 3. FIG. 6 is a plan view of the developing device 42, minus the top plate 14*g* (wall) of the device 42, and the development blade 13 of the device 42, which is a developer regulating member. FIG. 7 is an enlarged sectional view of the developing device 42, at a plane (7)-(7) indicated by arrow marks in FIG. 5. FIG. 8 is an enlarged sectional view of the developing device 42, at a plane (8)-(8) indicated by arrow marks in FIG. 5.

The developing device 42 of this referential image forming apparatus is of the so-called contact type, and also, of the so-called dry type. It uses nonmagnetic developer 11 (nonmagnetic single-component developer, which will be referred to simply as toner), which is negatively charged for image formation. That is, the normal polarity of the developer 11, or the polarity to which the developer 11 is charged for image formation, is negative.

The developing device 42 has an external frame 14 (shell) in which the toner 11 is stored. It has also a development roller 46, which bears the toner 11 and conveys the toner 11 to the development area E (FIG. 1) in which an electrostatic latent image formed on the peripheral surface of the drum 1 is developed. Further, it has an elastic development blade 13, which is placed in contact with the peripheral surface of the development roller 46 to form the toner layer borne by the development roller 46, into a uniform layer of toner having a preset thickness while the toner layer is conveyed to the development area E. Further, it has a sponge roller 12, as a developer supply roller, which is placed in contact with the development roller 46 to supply the development roller 46 with the toner 11.

In the case of this referential image forming apparatus, the external frame 14 (shell) of the developing device 42 is molded of high impact poly-styrene resin (HI-PS). Its front side is wide open as an opening 14*b*. It is roughly in the form of a parallelepiped. Its lengthwise direction is parallel to the left-right direction of the developing device 42.

Referring to FIGS. 3 and 4 it has left and right exterior panels 14*c*L and 14*c*R. It has also left and right interior panels 14*d*L and 14*d*R, which are positioned on the inward sides of the left and right exterior panels 14*c*L and 14*c*R, with the provision of a preset distance from the left and right exterior panels 14*c*L and 14*c*R, respectively. The left and right interior panels 14*d*L and 14*d*R extend in the front-rear direction. The aforementioned development roller 46 is rotatably positioned at the front opening 14*b* of the frame 14, in such an attitude that its axial line is parallel to the left-right direction of the frame 14.

In the case of this referential image forming apparatus, the development roller 46 is made up of a metallic core 47 and an elastic layer. The metallic core 47 which is 5 mm in external diameter functions as both the electrically conductive supporting member and electrode of the development roller 46. The elastic layer is in the form of a roller which is concentric with the metallic core 47. It is formed of semi-conductive silicon rubber (elastic rubber), in which electrical conductor has been dispersed. The development roller 46 is also provided with a surface layer which covers the silicon rubber layer. The surface layer is roughly 20 μm in thickness, and is formed of acrylic urethane rubber. It is formed by coating the outward surface of the elastic layer with acrylic urethane rubber. The development roller 46 is 12 mm in overall external diameter, $1\times10^{6}$–$1\times10^{9}\Omega$ in electrical resistance, and 57°±3° in hardness (in Asker hardness scale).

The left and right end portions of the metallic core 47 of the development roller 46 are rotatably supported by the development bearing holding left and right mechanisms 30L and 30R, with which the left and right end portions of the developing device frame 14 are provided, respectively. These development roller bearing holding mechanisms 30L and 30R will be described later in detail in Section (2) of this specification. The front side of the development roller 46 is exposed through the front opening 14*b* of the developing device frame 14. In the case of this referential image forming apparatus, the developing device 42 is driven from the right side. More specifically, the right end of the metallic core 47 of the development roller 46 is fitted with a development roller driving gear 17, in such a manner that the metallic core 47 is coaxial with the gear 17.

While the developing device 42 is used for development, driving force is inputted into the development roller driving gear 17 from the mechanical driving force source (unshown) of the main assembly 100A of the image forming apparatus 100. As the driving force is inputted into the gear 17, the development roller 46 is rotated in the clockwise direction indicated by an arrow mark R46 at a preset peripheral velocity. Referring to FIGS. 4 and 6, a referential code W46 stands for the overall width (overall length) of the development roller 46, which is greater than the distance W14*d* between the left and right internal plates 14*d*L and 14*d*R.

A referential code W1 stands for the overall width (overall length) of the drum 1, which is greater than the overall width W46 of the development roller 46.

In the case of this referential image forming apparatus, the sponge roller 12 is an elastic roller, and is 13 mm in external diameter. More concretely, it is made up of a metallic core 48 and a foamed layer. The metallic core 48, which functions as an electrically conductive substrate, is 6 mm in external diameter. The foamed urethane layer is formed around the peripheral surface of the metallic core 48, of foamed urethane, the foams of which are continuous. The sponge roller 12 is $1\times10^{9}\Omega$ in electrical resistance, and 60° in hardness (Asker hardness scale F). The sponge roller 12 is rotatably supported by the left and right internal plates 14*d*L and 14*d*R, with the placement of bearings 31L and 31R between the left and right end portions of the metallic core 48 of the sponge roller 12, and the left and right internal plates 14*d*L and 14*d*R, respectively.

The sponge roller 12 is placed in the rear side of the development roller 46, being in parallel to the development roller 46 and in contact with the development roller 46. The right end of its metallic core 48 is in connection to the developer roller driving gear 17 with the presence of the driving force transmitting mechanism 49 (FIG. 6) between the right end of the metallic core 48 and the mechanism 49. Although the detail of the driving force transmitting mechanism 49 is not shown in FIG. 6, the mechanism 49 is made up of a gear train, a belt, etc. It is a mechanism for transmitting rotational force from the developer roller driving gear 17 to the sponge roller 12 to rotate the sponge roller 12 in the preset direction at a preset speed.

Figure 1:
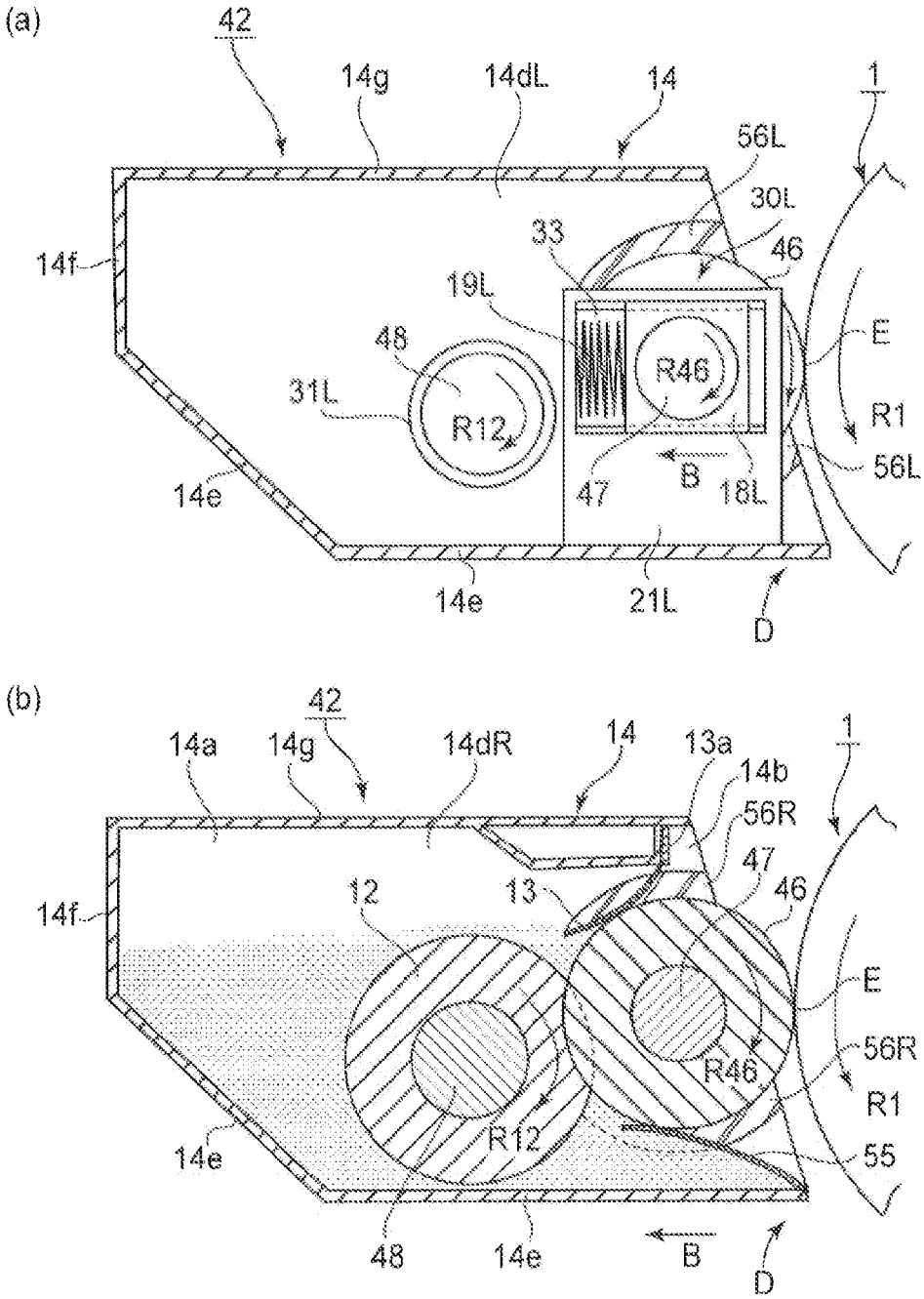
FIG. 1(*a*) is a schematic sectional view of the developing apparatus (device) of the first referential image forming apparatus, to which the present invention is applicable, and shows the position in which the movable bearing of the development roller bearing supporting mechanism of the developing device is when the device is being used for development, and the position in which the development roller is when the device is being used for development, and FIG. 1(*b*) is a schematic sectional view of the same developing apparatus (device) as the one in FIG. 1(*a*), and shows the states in which the development roller, sponge roller, and development blade of the device are when the development roller (bearing) is in the position shown in FIG. 1(*a*).

While the developing device 42 is used for development, rotational force is transmitted from the developer roller driving gear 17 to the sponge roller 12 through the driving force transmitting mechanism 49, whereby the sponge roller 12 is rotated in the clockwise direction indicated by an arrow mark R12 in FIG. 1, at a preset peripheral velocity. That is, the sponge roller 12 is rotated at the preset peripheral velocity in such a direction that in the nip between the sponge roller 12 and development roller 46, the peripheral surface of the sponge roller 12 moves in the opposite direction from the direction in which the peripheral surface of the development roller 46 moves. Referring to FIG. 6, a referential code W12 stands for the overall width (overall length) of the sponge roller 12, which is roughly the same as the distance W14*d* between the left and right internal plates 14*d*L and 14*d*R.

The elastic development blade 13 is positioned above the development roller 46. In the case of this referential image forming apparatus, the development blade 13 is made of metallic plate, more specifically, thin plate of phosphor bronze, which is 100 μm in thickness. One of its lengthwise edge portions is attached to the blade supporting plate 13*a*, which is attached to the front edge portion of the top plate 14*g* (top wall) of the developing device frame 14, in such a manner that the adjacencies of its functional (free) edge portion (one of lengthwise edge portions) is kept pressed upon the peripheral surface of the development roller 46 by its resiliency.

As for the attitude of the development blade 13, the development blade 13 is tilted in such a direction that its free edge (functional edge) is on the upstream side of the area of contact between the development blade 13 and development roller 46, in terms of the moving direction of the peripheral surface of the development roller 46 (tilted in counter direction). When the developing device 42 is in the state shown in FIG. 1, that is, while the developing device 42 is in use, the contact pressure between the development blade 13 and development roller 46 is 40 gf/cm.

Referring to FIG. 4, a referential code W13 stands for the overall width (overall length) of the development blade 13, which is roughly equal to the distance between the left and right internal plates 14*d*L and 14*d*R, which is roughly the same as the overall width W12 of the sponge roller 12. The development blade 13, which is between the left and right internal plates 14*d*L and 14*d*R, and the length of which is roughly equal to the distance between the left and right internal plates 14*d*L and 14*d*R, functions as a member for keeping sealed the gap between the peripheral surface of the development roller 46 and the top plate 14*g* of the developer device frame 14, in addition to a member for regulating the developer.

A referential code 55 stands for a toner catching elastic sheet made of plastic, which is placed below the development roller 46. It is solidly attached to the front edge portion of the bottom plate 14*e* (bottom wall) of the developing device frame 14 by its base side. The toner catching sheet 55 is positioned so that the portion of the sheet 55, which is adjacent to the unattached end of the sheet 55, is kept in contact with the peripheral surface of the development roller 46 by the resiliency of the sheet 55. It is tilted in such a direction that its unattached edge is on the downstream side of the area of contact between the sheet 55 and development roller 46 in terms of the rotational direction of the development roller 46.

The overall width (overall length) of the toner catching sheet 55 is roughly equal to the distance W14*d* between the left and right interior plates 14*d*L and 14*d*R. The sheet 55 is such a member of the developing device 42 that keeps sealed the gap between the development roller 46 and the bottom plate 14*e* of the developing device frame 14.

In the case of this referential image forming apparatus, the closed space surrounded by the left and right interior plates 14*d*L and 14*d*R, rear plate 14*f*, top plate 14*g*, development sleeve of a development roller 46, development blade 13, and developer catching sheet 55 serves as a developer storage chamber 14*a*, in which a preset amount of toner 11 is stored. The sponge roller 12 is within this developer storage chamber 14*a*.

The developing device frame 14 is structured so that roughly the rear half of the bottom plate 14*e* is tilted in such a direction that the front edge of the rear half of the bottom plate 14*e* is positioned lower than the rear edge of the rear half of the bottom plate 14*e*. That is, the developing device frame 14 is structured so that the toner 11 in the developer storage chamber 14 tends to flow toward the sponge roller 12. By the way, a paddle (toner stirring/conveying member) which can actively move the toner 11 in the developer storage chamber 14*a* toward the sponge roller 12 by being rotated about its axle may be placed in the rear portion of the developer storage chamber 14*a*.

The front end portion of the left interior plate 14*d*L, and the front end portion of the right interior plate 14*d*R, are provided with a semicircular recess, in which the corresponding lengthwise end portion of the development roller 46 fits. There are placed a pair of elastic seals 56L and 56R between the semicircular edges of the front end portions of the left and right interior plate 14*d*L and 14*d*R, and the left and right end portions of the development roller 46, respectively.

(2) Development Roller Supporting Mechanisms 30L and 30R

Figure 9:
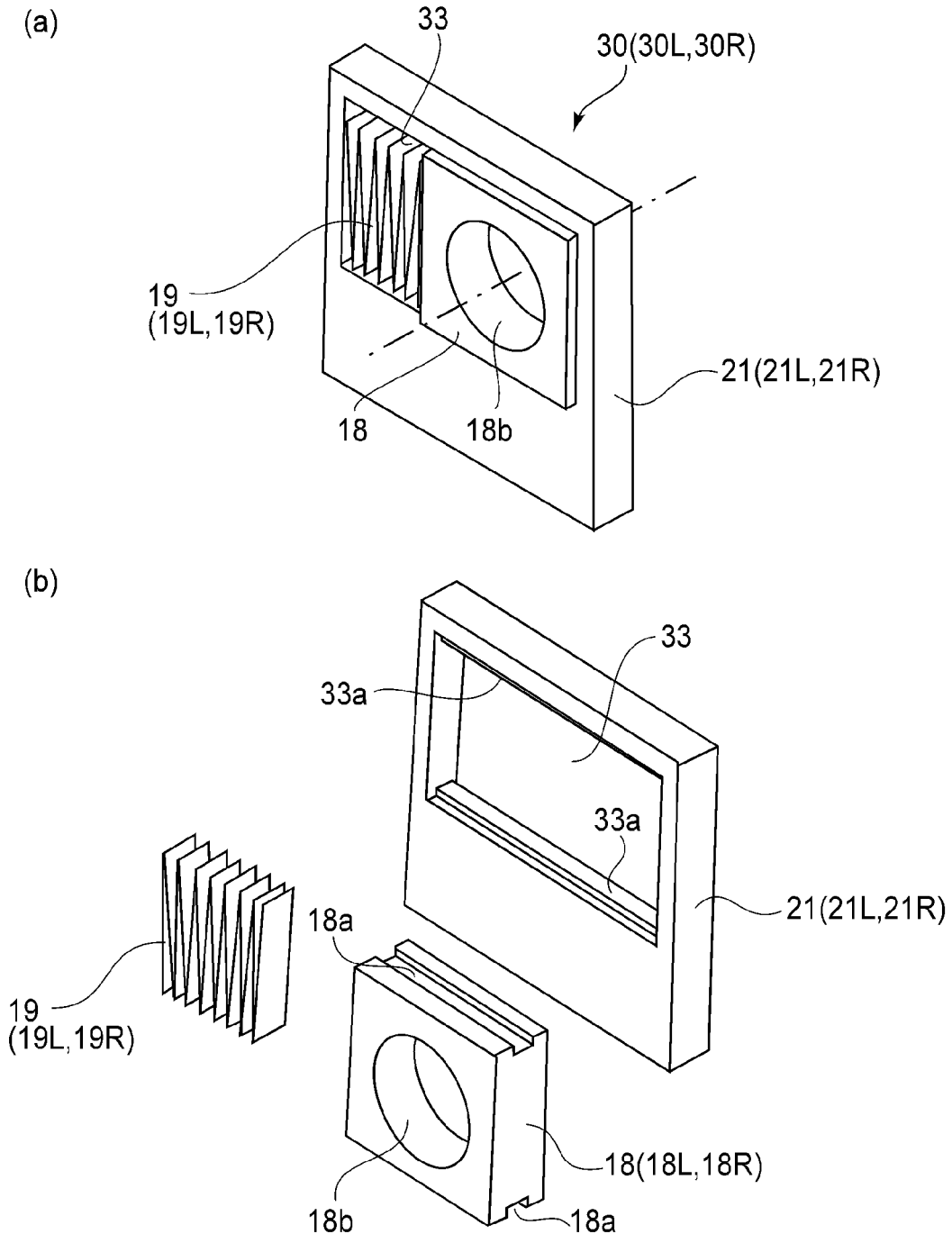
FIG. 9(*a*) is an external perspective view of the development roller bearing supporting mechanism of the developing device shown in FIG. 3, and FIG. 9(*b*) is an exploded perspective view of the mechanism shown in FIG. 9(*a*).

The development roller supporting mechanisms 30L and 30R which support the development roller 46 by the left and right end portions of the development roller 46 are attached to the bottom plate 14*e*, being symmetrically positioned in the adjacencies of the front opening 14*b* of the developing device frame 14. They are the same in structure. FIG. 9(*a*) is an external perspective view of one of the development roller supporting mechanisms 30 (30L and 30R), and FIG. 9(*b*) is an exploded perspective view of the development roller supporting mechanism 30.

The development roller supporting mechanism 30 has a development roller bearing 18 and a bearing holding member 21 (21L and 21R). The bearing holding member 21 has a rectangular hole in which the bearing 18 is fitted. It is solidly attached to the inward surface of the bottom plate 14*e* of the developing device frame 14 in such an attitude that the lengthwise direction of its rectangular hole 33 is parallel to the bottom plate 14*e*. The bearing 18 is square in contour. Thus, as it is fitted in the rectangular hole of the bearing holding member 21, it can be moved in the lengthwise direction of the rectangular hole. That is, the hole 33 functions as a guide for the bearing 18. More specifically, the bottom and top surfaces of the hole 33 are provided with a pair of rail-like protrusions 33*a*, which extend in the front-rear direction of the image forming apparatus 100. Further, the top and bottom surfaces of the bearing 18 are provided with grooves 18*a* and 18*a*, respectively, which extend in the front-rear direction of the image forming apparatus 100.

The bearing 18 is fitted in the rectangular hole 33 of the bearing holding member 21 in such a manner that the rail-like protrusions 33*a* and 33*a* of the bearing holding member 21 fit in the grooves 18*a* and 18*a*, respectively, of the bearing 18. Thus, the bearing 18 can be moved (slid) relative to the bearing holding member 21 in the frontward direction A (FIG. 8) and the rearward direction B (FIG. 1). The bearing 18 is provided with a hole 18*b*, which occupies the center portion of the bearing 18, and by the wall of which the lengthwise end portion of the metallic core 47 of the development roller 46 is rotatably borne.

Further, the development roller supporting mechanism 30 is provided with a spring 19 (19L and 19R) (pressure applying member), which is kept compressed between the rear surface (vertical surface) of the rectangular hole 33 of the bearing holding member 21 and the rear surface of the bearing 18. Thus, the bearing 18 remains under the pressure generated by the resiliency of the spring 19 in such a direction to move (slide) the bearing 18 in the frontward direction A within the rectangular hole 33. However, it can be slid in the rearward direction B while resisting the resiliency of the spring 19.

That is, the left and right bearings 18 by which the left and right end portions of the metallic core 47 of the development roller 46 are borne, respectively, are allowed by the left and right development roller supporting mechanisms 30L and 30R, to move in the frontward A and rearward B directions, relative to the developing device frame 14. Therefore, the development roller 46 is allowed to move in the frontward direction A and rearward direction B relative to the developing device frame 14. In other words, in the case of this referential image forming apparatus, the development roller supporting left and right mechanism 30L and 30R, which are made up of the movable (slidable) bearings 18 and springs 19 function as the mechanisms (developer bearing member displacing mechanisms) for displacing the development roller 46 relative to the developing device frame 14 in the frontward and rearward directions A and B.

Figure 10:
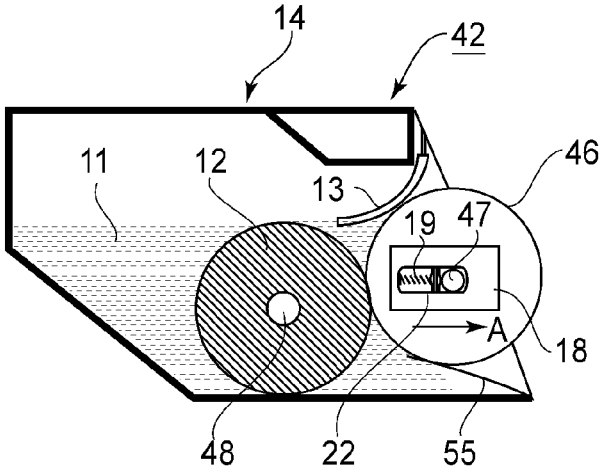
FIG. 10 is a schematic sectional view of a development roller bearing supporting mechanism, which is different in structure from the one shown in FIG. 9.

As the developing device 42 is moved out of its operational position, the movable bearings 18L and 18R of the development roller supporting left and right mechanisms 30L and 30R are moved by the resiliency of the compressed springs 19L and 19R, respectively, in the frontward direction A, that is, the direction to eliminate the contact pressure between the development roller 46 and sponge roller 12, and the contact pressure between the development roller 46 and development blade 13. Consequently, the bearings 18L and 18R are moved frontward until they come into contact with the front (vertical) surfaces (walls) of the rectangular holes 33 of the development roller supporting mechanisms 30 as shown in FIG. 8. Then, they remain in contact with the front surfaces of the rectangular holes 33 of the development roller supporting mechanisms 30; they remain in their frontmost positions. FIG. 10 shows the positional relationship among the development roller 46, sponge roller 12, and development blade 13 when the bearings 18L and 18R are in their frontmost positions.

The development roller 46 is moved into its frontmost position, which corresponds the frontmost positions of the bearings 18L and 18R, and remains there. The direction A in which the development roller 46 is displaced to be placed in its frontmost position, is the same as the direction in which the development roller 46 is moved away from the sponge roller 12 and development blade 13 to eliminate or reduce the contact pressure between the development roller 46 and sponge roller 12, and the contact pressure between the development roller 46 and development blade 13.

This referential image forming apparatus is structured so that when the development roller 46 is in the above described frontmost position, the amount of the apparent intrusion of the development roller 46 into the sponge roller 12 is 1.0 mm, and the width of the nip (area of contact) between the development roller 46 and sponge roller 12 is 0.75 mm in terms of the moving direction of the peripheral surface of the development roller 46, and the contact pressure between the development roller 46 and development blade 13 is 20 gf/cm.

In the case of this referential image forming apparatus 100, "the developing device 42 is free" means that it is completely out of the development position D in which it opposes the drum 1, or it is outside the rotary of the developing device 42.

FIG. 1(*a*) shows the position in which the movable bearing 18 of the development roller supporting mechanism 30 is (during development) after the developing device 42 which was in the free position as shown in FIG. 7 was moved into the development position D, in which the development roller 46 is kept in contact with the drum 1. FIG. 1(*b*) shows the position in which the development roller 46 is (during development) after the developing device 42 which was in the free position as shown in FIG. 8 was moved into the development position D, in which the development roller 46 is kept in contact with the drum 1.

In the case of this referential image forming apparatus, as one of the four developing devices 42 is moved by the rotation of the rotary 40 of the developing device 42, into the development position D in which this developing device 42 opposes the drum 1, the development roller 46 of this developing device 42 comes into contact with the drum 1, and is made to press on the drum 1 by the resiliency of the spring 19. Thus, the development roller 46 is kept in contact with the drum 1 by the spring 19 as long as this developing device 42 is kept in the development position D. Consequently, the development roller 46 is kept pressed rearward by the contact pressure between itself and drum 1, that is, the reaction force from the drum 1.

By this reaction force from the drum 1, the development roller 46 is moved rearward relative to the developer roller supporting left and right mechanisms 30, from the frontmost position to the rear position, shown in FIG. 1(*a*), against the resiliency of the spring 19, following the rectangular hole 33 of the bearing holding member 21, and pressing the spring 19 in the rearward direction B, that is, the direction to increase the contact pressure between the development roller 46 and drum 1.

The direction in which the development roller 46 is moved into the rearmost position relative to the developing device frame 14 is the same direction as the direction in which the development roller 46 has to be moved to increase the contact pressure between itself and sponge roller 12, and between itself and the development blade 13. This rearward movement of the development roller 46 relative to the developing device frame 14 is caused by the contact between the development roller 46 and drum 1, against the resiliency of the springs 19, sponge roller 12, elastic seals 56L and 56R, development blade 13, and developer catching sheet 55.

It is primarily against the resiliency of the springs 19 of the development roller supporting left and right mechanisms 30 that the development roller 46 is gradually pressed upon the drum 1 until a preset amount of contact pressure is generated between the development roller 46 and drum 1.

Further, this referential image forming apparatus is structured so that when the development roller 46 is in its rearmost position shown in FIGS. 1(*a*) and 1(*b*), into which the development roller 46 was moved in the rearward direction B from the frontmost position shown in FIGS. 8 and 9, the amount of apparent intrusion of the development roller 46 into the sponge roller 12 is within a range of 1.0 mm-1.5 mm, and the width of the contact nip is 1.0 mm, and also, the distance between the rotational axis of the development roller 46 and the rotational axis of the sponge roller 12 is 11.0 mm.

Further, this referential image forming apparatus is structured so that when the development roller 46 is in its rearmost position, the contact pressure between the development roller 46 and development blade 13 is 40 gf/cm. That is, while the developing device 42 is in use for development, the spring 19 remains compressed by the contact pressure between the development roller 46 and drum 1, ensuring that a proper amount of contact pressure is provided between the development roller 46 and sponge roller 12, and between the development roller 46 and development blade 13. In other words, this referential image forming apparatus is structured so that while the developing device 42 is in use for development, the development roller 46 remains pressed by the drum 1 to provide a preset amount of contact pressure between the sponge roller 12 and development roller 46, and also, between the development blade 13 and development roller 46, ensuring that an electrostatic latent image on the drum 1 is properly developed.

When the developing device 42 is locked in the development position D into which it is moved, and in which the developing device 42 opposes the drum 1, driving force is inputted into the driver gear 17 from the driving force source (unshown) of the main assembly 100A of the image forming apparatus 100, with a preset control timing. Thus, the development roller 46 is rotated in the clockwise direction indicated by an arrow mark R46 in FIG. 1, at a preset peripheral velocity. Further, the rotational force is transmitted to the sponge roller 12 through the driver gear 17 and driving force transmission mechanism 49, whereby the sponge roller 12 is rotated in the clockwise direction indicated by an arrow mark R12 in FIG. 1 at a preset peripheral velocity. Consequently, the direction in which the peripheral surface of the sponge roller 12 moves in the contact nip (area of contact) between the sponge roller 12 and development roller 46 moves becomes the opposite from the direction in which the peripheral surface of the development roller 46 moves in the contact nip.

Thus, the peripheral surface of the development roller 46 is rubbed by the peripheral surface of the sponge roller 12, which is moving in the opposite direction from the peripheral surface of the development roller 46, in the contact nip. Therefore, the peripheral surface of the development roller 46 is supplied with the toner 11 by the sponge roller 12. Referring to FIGS. 4 and 6, referential codes W46A and W46B stand for the width of the area of the development roller 46, across which the development roller 46 is supplied with the toner 11, and the width of the area of the development roller 46, across which the development roller 46 is not supplied with the toner 11, respectively. The width W46A is roughly the same as the maximum range of the drum 1 across which an image can be formed. In the case of this referential image forming apparatus, the width W46A is affected by the distance between the left and right interior plates 14*d*L and 14*d*R, respectively. The overall width W12 (overall length) of the sponge roller 12 is roughly equal to the distance W14*d*.

After being supplied to the development roller 46, the toner 11 is conveyed by the subsequent rotation of the development roller 46, to the area of contact between the development blade 13 and development roller 46, and is moved through the area of contact. While it is conveyed through the area of contact, the toner 11 on the development roller 46 is formed by the development blade 13 into a toner layer which is thin and uniform in thickness, while being given electrical charge. Then, the thin layer of the toner 11 on the development roller 46 is conveyed by the subsequent rotation of the development roller 46, to the development area E, which is the area of contact between the development roller 46 and drum 1, and then, through the area of contact. While the thin layer of toner 11 is conveyed through the development area E, the toner particles in the thin layer of the toner 11 are supplied to the drum 1. Further, while the thin layer of toner 11 is conveyed through the development area E, a preset development bias is applied to the metallic core 47 of the development roller 46 from the electric power source (unshown) of the apparatus main assembly 100A though the power supply system (unshown).

Thus, the toner on the development roller 46 is adhered to the exposed points of the electrostatic latent image on the drum 1, developing (reversal development) the electrostatic latent image into a visible image made of the toner. The toner which did not contribute to the development of the electrostatic latent image in the development area E, that is, the toner remaining on the peripheral surface of the development roller 46, on the downstream side of the development area E, is returned to the developing device frame 14 by the subsequent rotation of the development roller 46.

The toner which was returned to the developing device frame 14, without contributing to the development of the electrostatic latent image in the development area E, is conveyed further by the rotation of the development roller 46 to the contact nip between the development roller 46 and sponge roller 12, in which it is stripped from the peripheral surface of the development roller 46 by the friction between the sponge roller 12 and development roller 46. A part of the toner stripped from the development roller 46 is supplied again to the development roller 46, along with the toner supplied freshly from within the developer storage chamber 14*a*, by the sponge roller 12. The rest of the residual toner stripped from the development roller 46 remains in the developer storage chamber 14*a*. In the case of this referential image forming apparatus, the sponge roller 12 has both the function of supplying the development roller 46 with the toner, and the function of recovering the toner from the development roller 46.

As the developing device 42, which is in the development position D as shown in FIG. 1, is moved out of the development position D, the development roller 46 in this developing device 42 is separated from the drum 1. Thus, the development roller 46 stops pressing on the drum 1 (drum 1 stops pressing on development roller 46). As a result, the developing device 42 becomes free from the drum 1. As the developing device 42 becomes free from the drum 1, the movable bearings 18 are moved in the frontward direction A by the resiliency of the springs 19 of the development roller supporting left and right mechanisms 30. Consequently, the development roller 46 is moved from its rearmost position shown in FIG. 1, to its frontmost position shown in FIGS. 8 and 9. Thus, the contact pressure between the sponge roller 12 and development roller 46, and the contact pressure between the development blade 13 and development roller 46, are made nonexistent, or substantially reduced.

When a given developing device 42 is not in the development position D, that is, when the development roller 46 of the developing device 42 is not pressing on the photosensitive drum 1 (drum 1 is not pressing on development roller 46), the amount of apparent intrusion of the development roller 46 into the sponge roller 12 was 1.0 mm, and the contact pressure between the development roller 46 and development blade 13 was 20 gf/cm, which were substantially smaller than those when the developing device 42 is in the development position D.

However, if the contact pressure between the development blade 13 and development roller 46 is no more than 20 gf/cm, it is possible that the mechanical impact which occurs the moment when the rotary of the developing device 4 begins to be rotated, or stopped, will cause the toner to be blown out of the developer storage chamber 14*a* through the contact nip between the development roller 46 and development blade 13, and scatter. This is why it is desired that an image forming apparatus such as this referential image forming apparatus is structured so that when the developing device 42 is free from the drum 1, the contact pressure between the development blade 13 and development roller 46 is no less than 20 gf/cm.

In other words, this referential image forming apparatus is structured so that the contact pressure between the development blade 13 and development roller 46, and the contact pressure between the sponge roller 12 and development roller 46, are made virtually nonexistent, or are substantially reduced, at least in its developing devices which are not in use for development. Therefore, the development roller 46 which has an elastic layer, and the sponge roller 12 which also has an elastic layer, can be prevented from becoming irreversibly deformed.

(3) Modified Version of First Referential Image Forming Apparatus, etc.

1) In the case of the above described referential image forming apparatus to which the present invention is applicable, in order to move (displace) the development roller 46 in the direction to reduce the contact pressure between the development roller 46 and sponge roller 12, and the contact pressure between the development roller 46 and development blade 13, the image forming apparatus was structured so that the bearings 18 of the development roller supporting mechanisms 30, by which the development roller 46 is rotatably supported, can be moved (slid) relative to the development roller supporting mechanism 30, along the bearing guiding member 33*a* of the mechanism 30. However, the above-described referential image forming apparatus is not intended to limit the present invention in scope in terms of the structure of an image forming apparatus (developing device).

For example, the present invention is also applicable to an image forming apparatus structured, as shown in FIG. 10. That is, the bearing 18 is immovable, but is provided with an elongated rectangular hole 22. The spring 19 is positioned between the vertical rear surface (wall) of the rectangular hole 22, and the lengthwise end portion of the metallic core 47 of the development roller 46, so that the development roller 46 is kept pressed in the frontward direction A. The effects of this modification are the same as the effects of the application of the present invention to this referential image forming apparatus.

2) In the case of this referential image forming apparatus, thin plate of phosphor bronze was used as the material for the development blade 13. However, this referential image forming apparatus is not intended to limit the present invention in terms of the material for the development blade 13. For example, the present invention is also compatible with an image forming apparatus, the material for the development blade 13 of which is a sheet of urethane rubber. The effects of the application of the present invention to such an image forming apparatus is the same as those obtainable by the application of the present invention to this referential image forming apparatus.

3) The toner used by this referential image forming apparatus was nonmagnetic toner. However, this referential image forming apparatus is not intended to limit the present invention in terms of the toner which is to be used in order for an image forming apparatus to be compatible with the present invention. For example, the present invention is also compatible with an image forming apparatus which uses magnetic toner. The effects of the application of the present invention to an image forming apparatus which uses magnetic toner is the same as those obtainable by the application of the present invention to this referential image forming apparatus.

4) Further, this referential image forming apparatus was structured so that the sponge roller 12 of its developing device is rotated in the direction indicated by the arrow mark R12. However, this referential image forming apparatus is not intended to limit the present invention in terms of the direction in which the sponge roller 12 is to be rotated. That is, the present invention is also applicable to an image forming apparatus structured so that the sponge roller 12 of its developing device is rotated in the opposite direction from the direction indicated by the arrow mark R12, as long as there is a certain amount of difference between the peripheral velocity of the development roller 46 and that of the sponge roller 12, even if the apparatus is structured so that the sponge roller 12 is rotated by the rotation of the development roller 46. That is, all that is necessary for the present invention to be applicable to a given image forming apparatus is that the image forming apparatus is structured so that there is a certain amount of difference between the peripheral velocity of the development roller 46 and sponge roller 12. The effects obtainable by the application of the present invention to such an image forming apparatus is the same as those obtainable by the application of the present invention to this referential image forming apparatus.

5) Further, in the case of this referential image forming apparatus, the sponge roller 12 of its developing device is made up of the electrically conductive supporting member 48 (core) and the foamed layer supported by the electrically conductive supporting member 48 (core). However, this referential image forming apparatus is not intended to limit the present invention in terms of the structure of the sponge roller 12. That is, the present invention is also applicable to an image forming apparatus structured so that the foamed layer of the sponge roller of its developing device is supported by a dielectric supporting member, for example. The effects of the application of the present invention to such an image forming apparatus is the same as those obtainable by the application of the present invention to this referential image forming apparatus.

6) Further, the present invention is compatible with a developing device structured as follows: the lengthwise end portions of the development roller 46 are fitted with a pair of tracking rollers (spacer rollers) which are coaxial with the development roller 46. While the developing device is used for development, the spacer rollers remain in contact with the flanges, one for one, with which the lengthwise end portion of the drum 1 are provided to provide a preset amount of gap between the peripheral surface of the development roller 46 and the peripheral surface of the drum 1 so that an electrostatic latent image on the peripheral surface of the drum 1 is developed with no contact between the development roller 46 and drum 1.

[Second Referential Image Forming Apparatus to which Present Invention is Applicable]

Figure 11:
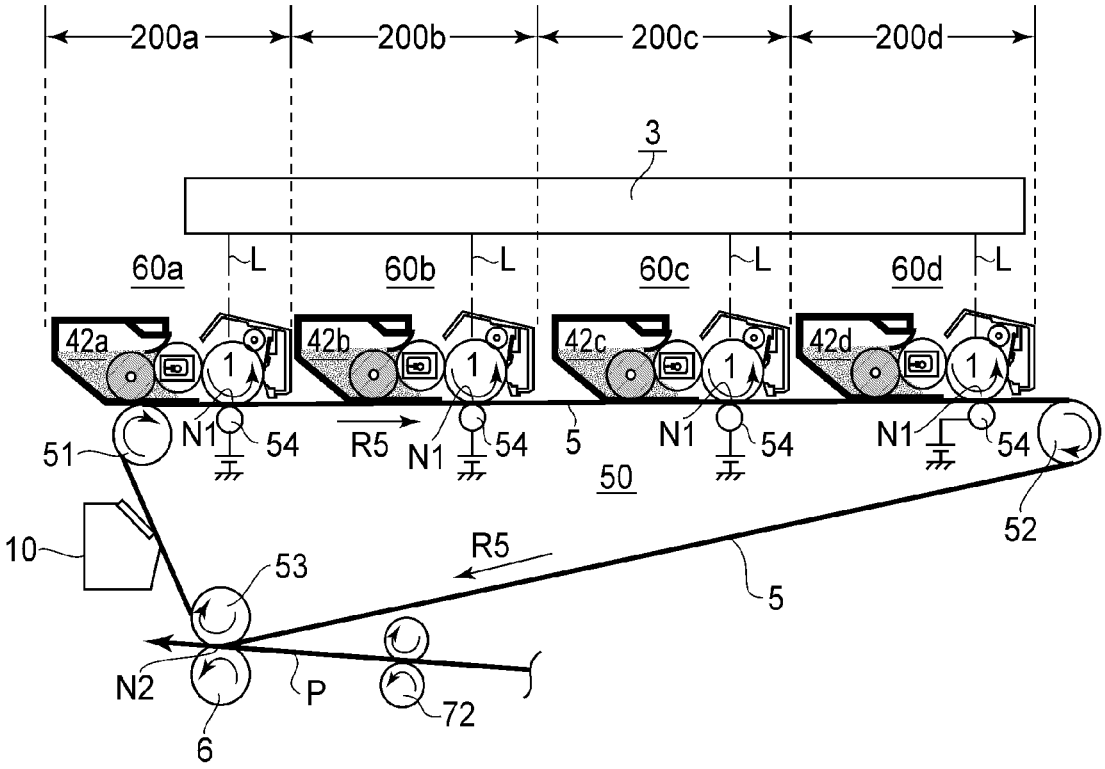
FIG. 11 is a schematic sectional view of the second referential image forming apparatus to which the present invention is applicable, and shows the general structure of the essential portions of the apparatus.

FIG. 11 is a schematic sectional view of the second referential image forming apparatus to which the present invention is applicable. It shows the general structure of the portions of the apparatus essential to the application of the present invention. This image forming apparatus is an electrophotographic multicolor image forming apparatus of the so-called tandem type (inline type). In the following description of this referential image forming apparatus, the structural components, and parts thereof, of this apparatus, which are the same as the counterparts in the first referential image forming apparatus described above, are given the same referential codes as those given to the counterparts, and are not described in order not repeat the same descriptions.

Figure 12:
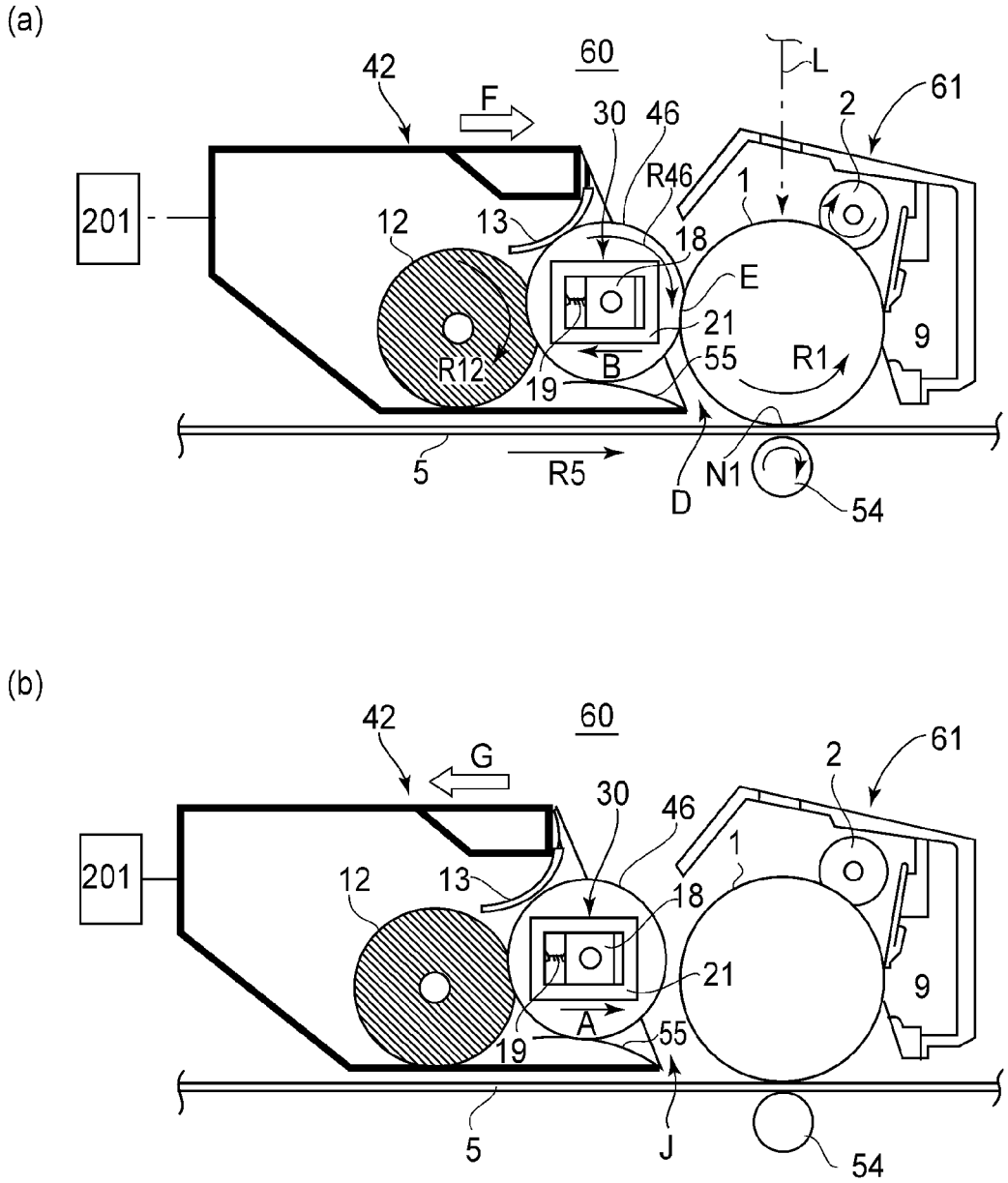
FIGS. 12(*a*) and 12(*b*) are enlarged sectional views of the essential portion of one of the image formation stations of the image forming apparatus shown in FIG. 11, when the developing device of the station is, and is not, being used, respectively.

This referential image forming apparatus is provided with four image formation stations 200 (200*a*, 200*b*, 200*c* and 200*d*), and an intermediary transfer belt unit 50. The intermediary transfer unit 50 is made up of an intermediary transfer belt 5, a belt driving roller 51 (driver roller, hereafter), a tension roller 52, and a belt backing roller 53. The four image formation stations 200 are positioned in the adjacencies of the top side of the loop which the belt 5 forms. In terms of the moving direction of the belt 5, they are between the driver roller 51 and tension roller 52, being aligned in parallel (in tandem) in the moving direction of the belt 5. The four image forming stations 200 are electrophotographic image formation systems and are the same in structure. Each station 200 has an electrophotographic photosensitive drum 1, a charge roller 2, an exposing device 3, a developing device 42, a drum cleaning device 9, etc. The developing device 42 is the same as that of the first referential image forming apparatus. FIG. 12(*a*) is an enlarged view of the essential portions of one of the image formation stations 200 while its developing device is in use for development.

The image formation station 200*a* has a developing device 42*a*, in which yellow (Y) toner is stored as developer. It forms a yellow (Y) toner image on its drum 1, and transfers the yellow (Y) toner image onto the belt 5, in the primary transfer station N1.

The image formation station 200*b* has a developing device 42*b*, in which magenta (M) toner is stored as developer. It forms a magenta (M) toner image on its drum 1, and transfers the magenta (M) toner image onto the belt 5 in such a manner that the magenta (M) toner image is layered on the yellow (Y) toner image on the belt 5, in the primary transfer station N1.

The image formation station 200*c* has a developing device 42*c*, in which cyan (C) toner is stored as developer. It forms a cyan (C) toner image on its drum 1, and transfers the cyan (C) toner image onto the belt 5, in such a manner that the cyan (C) toner image is layered on the yellow (Y) and magenta (M) toner images which have just been transferred in layers onto the belt 5, in the primary transfer station N1.

The image formation station 200*d* has a developing device 42*d*, in which black (K) toner is stored as developer. It forms a black (K) toner image on its drum 1, and transfers the black (K) toner image onto the belt 5, in such a manner that the black (K) toner image is layered upon the yellow (Y), magenta (M) and cyan (C) toner images having just been transferred in layers onto the belt 5, in the primary transfer station N1.

Consequently, four monochromatic toner images, different in color, that is, yellow (Y), magenta (M), cyan (C) and black (K) toner images, are layered on the belt 5. Then, the four toner images, different in color, are transferred together (secondary transfer) onto a sheet P of recording medium, in the secondary transfer station N2. Then, the sheet P having the layered four toner images, different in color, is conveyed to, and put through, the fixing device the apparatus. Then, it is outputted as a multicolor print.

Each image forming station 200 is in the form of a process cartridge 60 (60*a*, 60*b*, 60*c* and 60*d*). That is, the drum 1, and three drum processing devices, that is, charge roller 2, developing device 42, and drum cleaning device 9, are integrally placed in a cartridge, making up a process cartridge 60, which is removably installable in one of the preset process cartridge chambers of the main assembly of the image forming apparatus.

The cartridge 60 for this referential image forming apparatus consists of a drum unit 61 and a developing device 42 (development unit). The drum unit 61 is made up of the drum 1, and two, more specifically, the charge roller 2 and drum cleaning device 9, of the abovementioned three of the abovementioned processing devices, and a frame to which the drum 1 and the two processing devices are attached. The developing device 42 is attached to the drum unit 61 in such a manner that it can be pivotally moved relative to the drum unit 6.

Each cartridge 60 is installed into its a preset cartridge chamber in the main assembly 100A of the image forming apparatus 100. When the cartridge 60 is properly set in its preset cartridge chamber in the apparatus, its drum unit 61 is kept unmovable by the drum unit positioning portion of the apparatus main assembly 100A. The developing device 42 is pivotally movable relative to the unmovably positioned drum unit 61 in such a manner that it can be placed in its development position D shown in FIG. 12(*a*), and its home position J shown in FIG. 12(*b*), in which it is to be kept when it is not in use for development.

In other words, the cartridge 60 is structured so that the development roller 46 can be placed in contact with, or separated from, the drum 1. Referring to FIG. 12(*a*), the development position D for the developing device 42 is such a position that the development roller 46 is kept pressed upon the drum 1 with the presence of a preset amount of contact pressure between the development roller 46 and drum 1. Next, referring to FIG. 12(*b*), the home position J for the developing device 42 is such a position that the development roller 46 remains separated from the drum 1 by a preset amount of gap between itself and drum 1.

In the case of this referential image forming apparatus, the movement of the developing device 42 into its development position D is caused by the resiliency of an elastic member (unshown) with which the cartridge 60 is provided to keep the developing device 42 continuously pulled toward the drum unit 61 (in the direction indicated by arrow mark F). As for the movement of the developing device 42 into its home position J, it is caused by the developing device shifting mechanism 201, with which the apparatus main assembly 100A is provided to pull the developing device 42 in the direction indicated by an arrow mark G, which is the opposite direction from the direction indicated by the arrow mark F.

The developing device shifting mechanism 201 is made up of a cam, gears, etc., for example, and is controlled by the controlling means (unshown) of the apparatus main assembly 100A. In the case of this referential image forming apparatus, the shifting mechanism 201 is the means for placing the development roller 46 in contact with, or separating the development roller 46 from, the drum 1.

When the developing device 42 in each image formation station 200 is not needed for development, it is moved into the home position J by the developing device shifting mechanism 201 as shown in FIG. 12(*b*) so that the development roller 46 is kept separated from the drum 1. As the developing device 42 is moved into the home position J, the bearings 18 are displaced in the frontward direction A by the resiliency of the springs 19 of the development roller supporting left and right mechanisms 30, whereby the development roller 46 is moved frontward, as in the case of the first referential image forming apparatus. Therefore, the contact pressure between the development roller 46 and sponge roller 12, and the contact pressure between the development roller 46 and development blade 13, are completely eliminated or significantly reduced.

On the other hand, when the developing device 42 in each image formation station 200 is in use for development, the developing device 42 is not pulled by the developing device shifting mechanism 201. Thus, the developing device 42 is pulled toward the drum unit 61 by the resiliency of the elastic member of the cartridge 60. Consequently, the development roller 46 is placed, and kept, in contact with the drum 1. The elastic members are made greater in resiliency than the springs 19 of the development roller supporting left and right mechanisms 30.

Therefore, the development roller 46 is moved from its frontmost position shown in FIG. 12(*a*) to its rearmost position shown in FIG. 12(*b*), being guided by the hole 33 while pressing the bearings 18 of the development roller supporting left and right mechanisms 30, against the resiliency of the springs 19, in the rearward direction B, which is the direction to increase the contact pressure between the development roller 46 and sponge roller 12, and the contact pressure between the development roller 46 and development blade 13. The direction in which the development roller 46 is displaced into its rearmost position is the same as the direction in which the development roller 46 is to be moved, while being kept in contact with the sponge roller 12 and development blade 13, to increase the contact pressure between itself and sponge roller 12, and the contact pressure between itself and development blade 13.

As the development roller 46 is moved into its rearmost position, the contact pressure between the development roller 46 and sponge roller 12, and the contact pressure between the development roller 46 and development blade 13, increase to present amounts, and so does the contact pressure development roller 46 and drum 1.

As described above, also in the case of this referential image forming apparatus, when a given developing device 42 is not used for development, it is kept in the condition in which the contact pressure between the development roller 46 and sponge roller 12, and the contact pressure between the development roller 46 and development blade 13, are virtually nonexistent, or significantly smaller, than when the developing device 42 is in use for development. Therefore, the development roller 46 and sponge roller 12, the functional layers of which are formed of elastic substance, are prevented from being irreversibly deformed by a significant amount.

Unlike the rotary developing device 4 of the first referential image forming apparatus, the developing device in this referential image forming apparatus is a part of the process cartridge. Therefore, it is smaller in the amount of the impact to which a developing devices are subjected. More specifically, in the case of a rotary developing device 4, its developing device is subjected to a mechanical shock when the moment when its rotary begins to be rotated, or the moment when its rotary is stopped. This shock possibly causes the toner to be blown out of the developing device 42 through the contact nip between the development roller 46 and development blade 13. In the case of this referential image forming apparatus, however, the developing device 42 is a part of the process cartridge 60. Therefore, this referential image forming apparatus is significantly smaller in the amount of the above described shocks to which its developing device 42 is subjected, and therefore, it is less in the possibility that the toner will be blown out of the drum 1 through the abovementioned contact nip. Therefore, it is significantly greater in the amount (distance) by which the development roller 46 can be displaced to reduce the contact pressure between itself and sponge roller 12, and the contact pressure between itself and development blade 13, than the first referential image forming apparatus.

In the case of this referential image forming apparatus, which uses a process cartridge system, even when the amount of the apparent intrusion of the development roller 46 into the sponge roller 12, and the contact pressure between the development roller 46 and development blade 13, were reduced to 0.5 mm and 10 gf/cm, respectively, which were significantly smaller than in the case of the first referential image forming apparatus, the toner was not blown out of the development storage chamber. This proves that the first referential image forming apparatus can be substantially reduced in the amount of the irreversible deformation of the development rollers 46 and sponge rollers 12 of its developing devices 42, which are partially formed of elastic substance, by replacing its developing devices 42 with developing devices of the process cartridge type.

Also, in the case of this referential image forming apparatus, nonmagnetic toner was used as developer. Therefore, the sponge roller 12 is used as the toner supplying member. However, this referential image forming apparatus is not intended to limit the present invention in terms of the toner supplying member. That is, the present invention is also applicable to an image forming apparatus which does not use the sponge roller 12 as the toner supplying member. For example, the present invention is also applicable to an image forming apparatus employing developing devices which use magnetic toner, and the development rollers 46 having an internal magnetic roller. In the case in which the present invention is applied to an image forming apparatus employing developing devices having no sponge roller, it is only the contact pressure between the development roller 46 and development blade 13 that is eliminated when the development roller 46 is separated from the drum 1.

Regarding the pivotal movement of the developing device 42 relative to the drum unit 60, the present invention is also applicable to this referential image forming apparatus, even if the apparatus is modified so that the drum unit 61 pivotally moves relative to the developing device 42, which is immovable.

The above-described process cartridge 60 is not intended to limit the present invention in terms of the structure of a process cartridge to which the present invention is applicable. That is, it is only one example of process cartridge structures with which the present invention is compatible. That is, not only is the present invention compatible with the image forming apparatuses in the following embodiments of the present invention, but also, the apparatuses which employ an image forming apparatus in accordance with the present invention, modifications of the image forming apparatuses in the following embodiments, and their combinations.

Embodiment 1

Hereinafter, embodiments of the present invention are described with reference to the above-described referential image forming apparatuses to which the present invention is applicable. In the description of the following embodiments of the present invention, the structure of each image forming apparatus may not be described if it is similar to those of the first and second referential image forming apparatuses described above.

Figure 17:
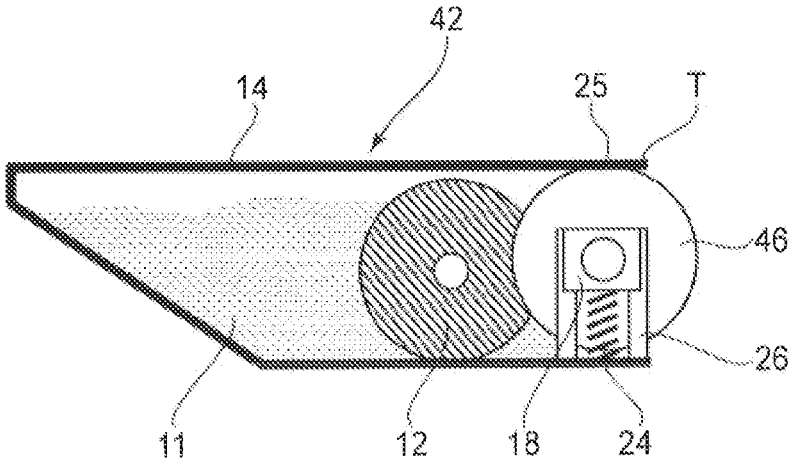
FIG. 17 is a schematic sectional view of one of the developing devices comparable to the developing device in the first embodiment of the present invention.

Referring to FIG. 17, the developing device 42 is made up of the development roller 46, frame 14, sponge roller 12, and a pressure applying member 24 for pressing, and keeping pressed, the development roller 46 upon the toner regulating member 25, which is a part of the developing device frame 14. Thus, structuring the developing device 42 so that the development roller 46 is pressed toward the toner regulating portion 25 to regulate in thickness the toner layer on the development roller 46 can substantially reduce the developing device 42 in thickness (dimension in terms of direction perpendicular to development roller displacement direction).

In the case of this developing device structured as described above (which will be referred to as comparative developing device, hereafter), the toner layer regulating portion 25 is a part of the top wall of the developing device frame 14, being therefore immovable. Therefore, it is impossible for the contact pressure between the toner layer regulating portion 25 and drum 1 to be eliminated or reduced, like the contact pressure between the toner layer regulating member and development roller of the developing device disclosed in Japanese Laid-open Patent Application H03-24571, by a contact pressure controlling means. Further, even if the pressure applying member 24 is reduced in the amount of pressure it can generate, in order to reduce the contact pressure between the development roller 46 and toner layer regulating portion 25, the contact pressure between the development roller 46 and sponge roller 12 is not eliminated. Therefore, the sponge roller 12 is irreversibly deformed.

Figure 13A:
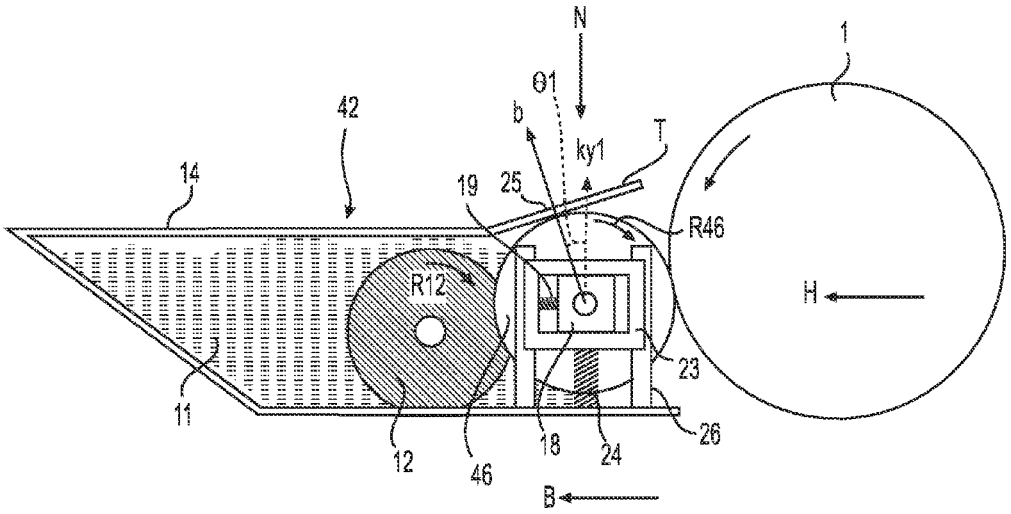
FIG. 13 is a schematic sectional view of the developing device and photosensitive drum in the first embodiment of the present invention, and shows the structure and operation of the developing device.
Figure 13B:
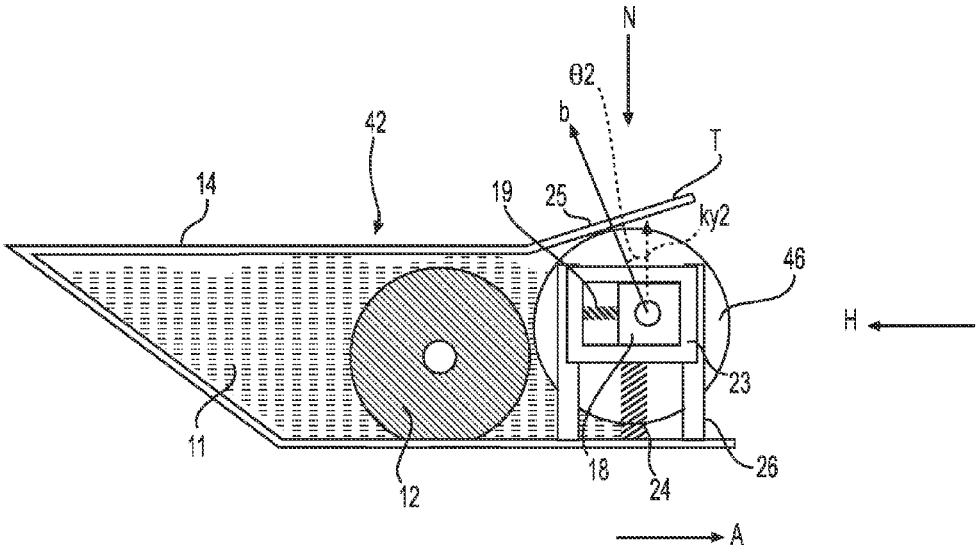

The characteristic features of the developing device 42 in this embodiment of the present invention is described with reference to the problems of the abovementioned comparative developing device. Referring to FIG. 13, one of the characteristic features of this developing device 42, which is relatively thin, is that the portion of the inward surface of the top wall of the developing device frame 14 (regulating surface T), which is for regulating the toner layer on the development roller 46, is tilted, in order to ensure that as the development roller 46 is moved in the direction indicated by an arrow mark A, the contact pressure generated between the development roller 46 and the toner layer regulating portion 25 by the pressure applying member 24 reduces. More specifically, in this embodiment, the regulating surface T is tilted by an angle of θ1 relative to the direction indicated by the arrow mark A, in FIG. 13 (plane perpendicular to axial line of development roller 46). The other portions of the developing device 42 in this embodiment are the same in structure and function as the counterparts of the developing device of the first referential image forming apparatus, and therefore, are not described here.

The developing device 42 in this embodiment is structured as described above. Therefore, when the developing device 42 is not in use for development, the contact pressure between the development roller 46 and toner layer regulating portion 25 (developer layer regulating surface), and the contact pressure between the development roller 46 and sponge roller 12, can be virtually eliminated or substantially reduced, by simply moving the development roller 46 in the direction indicated by the arrow mark A (second direction). Therefore, this embodiment can prevent the development roller 46 and sponge roller 12 from being irreversibly deformed.

Next, the developing device 42 which characterizes this embodiment of the present invention is described. FIG. 13(*a*) is a schematic sectional view of the combination of the developing device 42 and drum 1 in this embodiment, when the developing device 42 is in use for development. In this embodiment, a spring is used as the pressure applying member 24. Further, the regulating surface T is tilted so that as the development roller 46 is moved in the direction indicated by the arrow mark A, the contact pressure between the development roller 46 and regulating surface T reduces.

To describe in detail the regulating surface T, it is tilted in such a direction that when the developing device 42 is in use for development, the contact pressure between the toner regulating surface T and development roller 46 is higher than when the developing device 42 is not in use for development.

Figure 15:
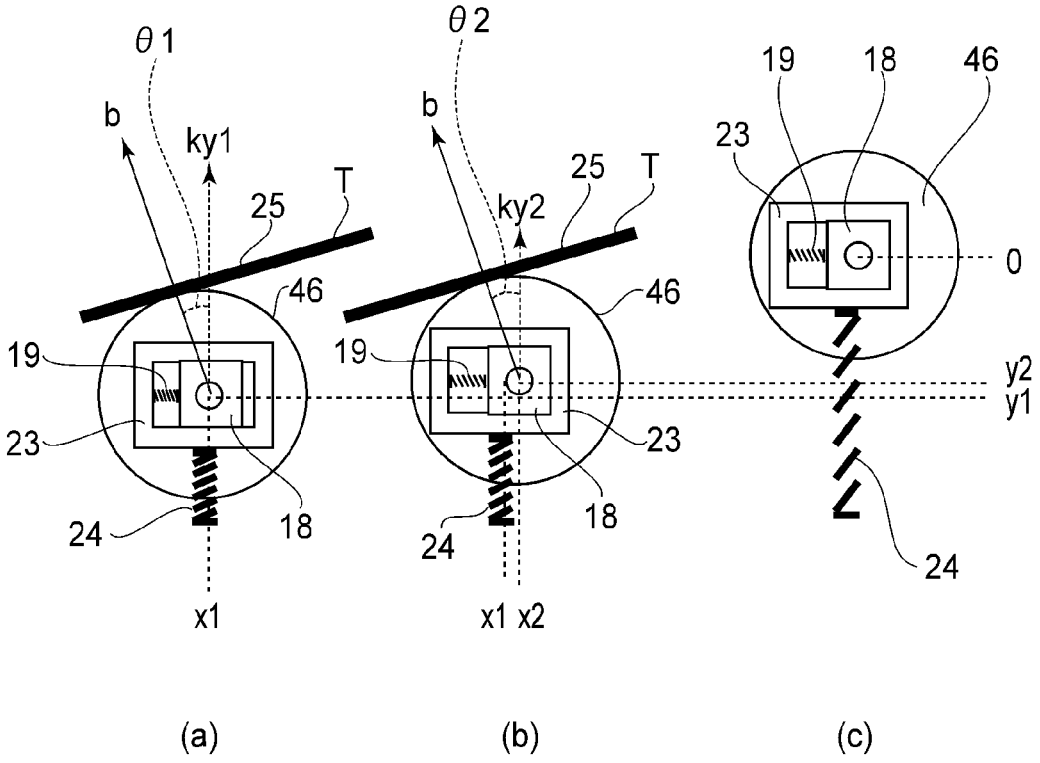
FIGS. 15(*a*), 15(*b*) and 15(*c*) are schematic sectional views of the development roller, development roller bearing, and toner layer regulating portion (surface) of the developing device in the first embodiment, and show the state of contact between the development roller and toner layer regulating portion.

The states of contact between the development roller 46 and regulating surface T when the developing device 42 is in use for development, and that when the developing device 42 is not in use for development, are shown in FIGS. 15(*a*) and 15(*b*), respectively. The state of the developing device 42 in which the spring 24 is remaining uncompressed is shown in FIG. 15(*c*).

Referring to FIGS. 15(*a*) and 15(*b*), it is assumed here that the angle between the direction in which the spring 24 presses the development roller supporting member 23 when the developing device 42 is in use for development, and the direction b which is perpendicular to the toner layer regulating portion 25 is θ1, and that when the developing device 42 is not in use for development is θ2, and the spring constant of the spring 24 is k, and also, that, in terms of the direction parallel to the direction of the top and bottom edge of the development roller supporting member 23, the position in which the development roller 46 is when the developing device 42 is in use for development is x1, and the position in which the development roller 46 is when the developing device 42 is not in use for development is x2, and the direction in which the development roller supporting member 23 is pressed by the springs 24 when the developing device 42 is in use for development is y1, and that when the developing device 42 is not in use for development is y2.

Referring to FIGS. 15(*a*), 15(*b*) and 15(*c*), y1 and y2 stand for the amounts by which the spring 24 remains compressed relative to its natural length when the developing device 42 is in use, and is not in use, respectively, for development.

Next, referring to FIGS. 15(*a*) and 15(*b*), as the developing device 42 is moved from the development position D, in which the contact pressure between the development roller 46 and drum 1 is highest, to the home position J, in which the contact pressure between the development roller 46 and drum 1 is lowest, the position of the development roller 46, in terms of the developing device displacement direction, changes from x1 to x2, and the position, in terms of the direction in which the development roller 46 is pressed by the spring 24, at which the development roller 46 is kept pressed by the spring 24, changes from y1 to y2.

The regulating surface T is tilted so the following Inequality A is satisfied:

$$ky1 \cdot \cos\theta1 > ky2 \cdot \cos\theta2 \quad \text{(A).}$$

ky1 and ky2 stand for the amount of the forces which the spring 24 applies to the development roller 46 when the spring 24 is in the states shown in FIGS. 15(*a*) and 15(*b*), respectively.

The left side of Inequality A indicates the amount of force by which the development roller 46 presses on the regulating surface T when the developing device 42 is in use for development, and the right side of Inequality A indicates the amount of force by which the development roller 46 presses on the regulating surface T when the developing device 42 is not in use for development. Inequality A means that when the developing device 42 is in use for development, the contact pressure between the development roller 46 and regulating surface T is greater than when the developing device 42 is not in use for development. In this embodiment, the developing device 42 was structured so that both the angles θ1 and θ2 become 20° (θ1=θ2=20°).

Figure 14A:
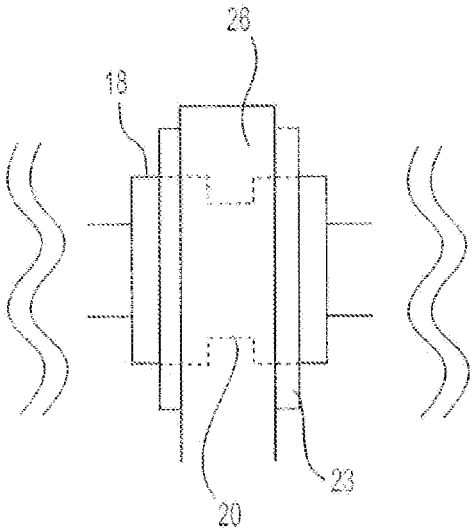
FIG. 14 is a schematic drawing of the mechanism of the developing device in the first embodiment, which allows the development roller to be displaced while keeping the development roller under pressure.
Figure 14B:
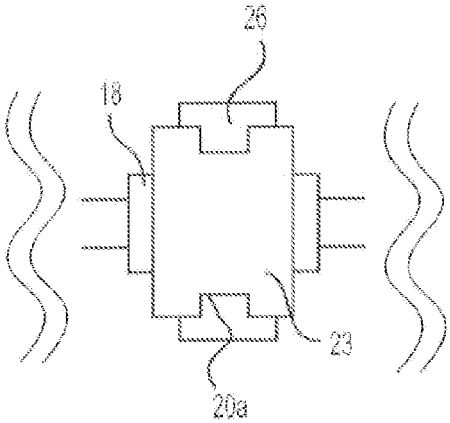

Next, referring to FIGS. 13 and 14, the mechanism, in this embodiment, for displacing the development roller 46 and keeping the development roller 46 pressed upon the regulating surface T and sponge roller 12 to develop an electrostatic latent image is described. The developing device 42 is structured so that, in terms of the direction parallel to the rotational axis of the development roller 46, the area in which its development roller 46 is rotatably borne by the bearing 18, by its lengthwise end from which the development roller 46 is driven, is outside the image formation range. Referring to FIG. 13(*a*), it is to the bearing 18 that the spring 19 is attached.

Since the direction in which the development roller 46 is displaced by the resiliency of the spring 19 is the same as the direction (second direction) indicated by the arrow mark A, the direction indicated by the arrow mark A is the direction in which the development roller 46 (bearings 18) are to be moved to reduce the contact pressure between the development roller 46 and regulating surface T, and the contact pressure between the development roller 46 and sponge roller 12.

Referring to FIG. 13(*a*), the bearing 18 is fitted in the bearing guiding movable guide 23. FIG. 14(*a*) is a schematic plan view of the lengthwise end portion of the development roller 46, from which the development roller 46 is driven, as seen from the direction indicated by an arrow mark H in FIG.

13(*a*). Referring to FIG. 14, the bearing 18 is provided with a groove 20 in which the rail-like protrusions of the bearing guiding movable guide 23 fits. With the employment of this structural arrangement, the development roller 46 is movable in the same direction as the direction indicated by the arrow mark A in FIG. 13, in which the development roller 46 is allowed to move.

In addition, the bearing guiding movable guide 23 is provided with the spring 24, which is kept compressed as shown in FIG. 13(*a*) so that the force generated by the spring 24 becomes 8.5 N. Thus, as the bearing guiding movable guide 23 causes the development roller 46 to come into contact with the developing device frame 14 (regulating surface T), the development roller 46 is pressed toward the toner layer regulating portion 25 (developer layer regulating portion) of the developing device frame 14 (in the first direction) while being allowed to rotate. That is, the development roller 46 is displaceable in the first direction, that is, toward the toner layer regulating portion 25 (direction in which the development roller bearing supporting member 23 is pressed by spring 24; direction indicated by arrow mark ky1 in FIG. 15(*a*)). Moreover, the development roller 46 is displaceable in the second direction (displacement directions B and A in FIGS. 13(*a*) and 13(*b*), respectively); direction in which bearing 18 (development roller 46) is pressed by the spring 19), which intersects the first direction. In other words, the development roller 46 is displaceable in two different directions.

Referring to FIG. 13(*a*), the bearing guiding movable guide 23 is fitted in the stationary guide 26. FIG. 14(*b*) is a schematic plan view of the lengthwise end portion of the development roller 46, from which the development roller 46 is driven, as seen from the direction indicated by an arrow mark N in FIG. 13(*a*). The movable guide 23 is provided with a groove 20*a*, in which the rail-like protrusion of the stationary guide 26 fits. With the employment of this structural arrangement, the development roller 46 is allowed to displace toward the toner layer regulating portion 25 (first direction).

The opposite lengthwise end portion of the developing device 42 from the lengthwise end portion from which the development roller 46 is driven, is also provided with a mechanism for moving and pressing the development roller 46. Therefore, the development roller 46 is pressed toward the toner layer regulating portion 25 from both its lengthwise end portion from which it is driven, and its lengthwise end portion from which it is not driven.

With the employment of the above described structural arrangement, the spring 19 (pressure applying second member) and spring 24 (pressure applying first member) remain compressed by the contact between the development roller 46 and drum 1, ensuring that a proper amount of contact pressure is maintained between the development roller 46 and sponge roller 12, and between the development roller 46 and toner layer regulating surface T (regulating surface), when the developing device 42 is in use for development. On the other hand, in the developing devices which are not in use for development, there is virtually no contact pressure between the development roller 46 and drum 1.

Referring to FIG. 13(*b*), with the disappearance of the contact pressure between the development roller 46 and drum 1, the development roller 46 is pressed in the direction (second direction) indicated by the arrow mark A by the spring 19, and also, in the direction (first direction) of the toner layer regulating portion 25. Consequently, the development roller 46 is moved in the direction in which the development roller 46 is to be displaced to eliminate or reduce the contact pressure between the development roller 46 and sponge roller 12, and the contact pressure between the development roller 46 and development blade 13.

Therefore, it is ensured that at least when the developing device 42 is not actually in use for development, there is virtually no contact pressure between the development roller 46 and regulating surface T (regulating portion), and between the development roller 46 and sponge roller 12. Thus, this embodiment can prevent the problem that when an electrophotographic image forming apparatus is not in use for image formation, its development roller 46 and sponge roller 12, which are partially formed of an elastic substance, are irreversibly deformed.

Incidentally, in this embodiment, in order to move the development roller 46 in the direction to rid the development roller 46 of its contact pressure, the mechanism structured so that the bearing 18 is allowed to slide along the bearing supporting movable guide 23, was employed. However, this embodiment is not intended to limit the present invention in terms of how to move the development roller 46 in the direction to rid the development roller 46 of the contact pressure.

Figure 16:
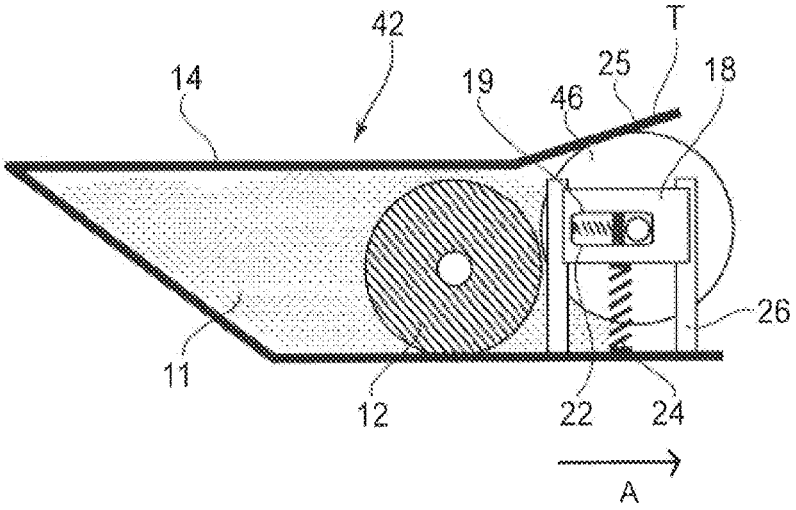
FIG. 16 is a schematic sectional view of one of the modified version of the developing device in the first embodiment.

For example, the developing device 42 may be structured as shown in FIG. 16: The bearing 18 is provided with a hole 22, in which the lengthwise end portion of the metallic core of the development roller 46 is supported in such a manner that the lengthwise end portion of the metallic core of the development roller 46 can be slid along the top and bottom walls (surfaces) of the hole 22, and a spring 19 is positioned between the front vertical wall (surface) of the hole 22 and the front surface of the bearing 18, to keep the development roller 46 pressed in the direction indicated by an arrow mark A. The effects of this structural arrangement are the same as the structural arrangement for the developing device 42 in this embodiment.

Further, the developing device 42 may be integrated as a part of the process cartridge in the second embodiment, in order to further the effects of this embodiment, that is, the prevention of the irreversible deformation of the development roller 46 and sponge roller 12.

Further, in this embodiment, the toner layer regulating surface T is straight in cross section. However, this embodiment is not intended to limit the present invention in terms of the shape of the toner layer regulating surface T. That is, the present invention is also applicable to an image forming apparatus (developing device), the toner layer regulating surface T of which has a certain amount of curvature, in cross section. The effects of the application of the present invention to such an image forming apparatus (developing device) are the same as those obtainable by this embodiment.

In addition, in this embodiment, the toner layer regulating surface T is straight in cross section. Therefore, $\theta 1$ is equal to $\theta 2$. However, this embodiment is not intended to limit the present invention in terms of the relationship between $\theta 1$ and $\theta 2$. That is, the present invention is also applicable to an image forming apparatus, in which $\theta 1$ is not equal to $\theta 2$, as long as the apparatus (device) is structured to satisfy Inequality A.

Further, in this embodiment, the toner layer regulating portion (developer layer regulating portion) was an integral part of the developing device frame 14. However, the present invention is also applicable to an image forming apparatus (developing device), which is provided with a toner regulating portion 25, which is not an integral part of developing device frame 14, and which is solidly attached to the developing device frame 14, as long as the image forming apparatus (developing device) is structured so that after the development roller 46 is moved into the development position D (in which preset amount of contact pressure is present between development roller 46 and toner layer regulating portion 25), the regulating surface T of the toner layer regulating portion 25 is kept in a preset attitude (at preset angle) relative to the second direction in which the development roller 46 is allowed to displace.

The effects of the present invention described with reference to the preceding embodiments of the present invention may be summarized as follows:

The primary object of the present invention is to provide a developing device (apparatus) which is substantially smaller, and simpler in structure, than any developing device in accordance with the prior art, and yet can prevent the prevent the problem that the developer bearing member and developer supplying member of a developing device (apparatus) is irreversibly deformed, as effectively as, or more effectively, than ay developing device (apparatus) in accordance with the prior art.

Another object of the present invention is to provide a process cartridge and an image forming apparatus, which are equipped with a developing device in accordance with the present invention.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 145573/2012 filed Jun. 28, 2012 which is hereby incorporated by reference.

What is claimed is:

1. A developing apparatus for developing a latent image formed on an image bearing member, the developing apparatus comprising:

a developing container for accommodating developer;

a rotatable developer carrying member for carrying the developer to a developing zone for developing the latent image;

a developer regulating portion configured to regulate a thickness of a layer of the developer carried on said developer carrying member to a predetermined thickness;

a developer feeding member configured to supply the developer to said developer carrying member;

an urging member for urging said developer carrying member toward said developer regulating portion; and a supporting mechanism for supporting said developer carrying member movably in a first direction that is a direction in which said urging member urges said developer carrying member and in a second direction crossing with the first direction, wherein a press-contact force received by said developer carrying member from said developer feeding member increases or decreases by movement of said developer carrying member in the second direction.

2. An apparatus according to claim 1, further comprising a second urging member for urging said developer carrying member in the second direction so as to reduce or remove the press-contact force.

3. An apparatus according to claim 1, wherein said supporting mechanism includes a bearing member for rotatably holding said developer carrying member, and a guide for sliding of said bearing member.

4. An apparatus according to claim 1, wherein said developer carrying member moves toward said developer feeding member by making contact with said image bearing member.

5. An apparatus according to claim 1, wherein said developer regulating portion is inclined relative to the first and second directions.

6. An apparatus according to claim 1, wherein said developer regulating portion is integral with said developing container.

7. A process cartridge detachably mountable to an assembly of an image forming apparatus, said process cartridge comprising:

an image bearing member for bearing a latent image;

a developing container for accommodating a developer;

a rotatable developer carrying member for carrying the developer to a developing zone for developing the latent image;

a developer regulating portion configured to regulate a thickness of a layer of the developer carried on said developer carrying member to a predetermined thickness;

a developer feeding member configured to supply the developer to said developer carrying member;

an urging member for urging said developer carrying member toward said developer regulating portion; and a supporting mechanism for supporting said developer carrying member movably in a first direction that is a direction in which said urging member urges said developer carrying member and in a second direction crossing with the first direction, wherein a press-contact force received by said developer carrying member from said developer feeding member increases or decreases by movement of said developer carrying member in the second direction.

8. A process cartridge according to claim 7, further comprising a second urging member for urging said developer carrying member in the second direction so as to reduce or remove the press-contact force.

9. A process cartridge according to claim 7, wherein said supporting mechanism includes a bearing member for rotatably holding said developer carrying member, and a guide for sliding of said bearing member.

10. A process cartridge according to claim 7, wherein said developer carrying member is movable toward and away from said image bearing member, and said developer carrying member moves toward said developer feeding member by making contact with said image bearing member.

11. A process cartridge according to claim 7, wherein said developer regulating portion is inclined relative to the first and second directions.

12. A process cartridge according to claim 7, wherein said developer regulating portion is integral with said developing container.

13. An image forming apparatus for forming an image on a recording material, said image forming apparatus comprising:

an image bearing member for bearing a latent image;

a developing container for accommodating a developer;

a rotatable developer carrying member for carrying the developer to a developing zone for developing the latent image;

a developer regulating portion configured to regulate a thickness of a layer of the developer carried on said developer carrying member to a predetermined thickness;

a developer feeding member configured to supply the developer to said developer carrying member;

an urging member for urging said developer carrying member toward said developer regulating portion in a first direction; and a moving mechanism for moving said developer carrying member in a second direction crossing with the first direction, wherein a press-contact force received by said developer carrying member from said developer feeding member by contact there between increases or decreases by movement of said developer carrying member in the second direction.

14. An apparatus according to claim 13, further comprising a second urging member for urging said developer carrying member in the second direction so as to reduce or remove the press-contact force.

15. An apparatus according to claim 13, wherein said moving mechanism includes a bearing member for rotatably holding said developer carrying member, and a guide for sliding of said bearing member.

16. An apparatus according to claim 13, wherein said developer carrying member is movable toward and away from said image bearing member, and said image forming apparatus further comprises a second moving mechanism for relative movement between said developer carrying member and said image bearing member toward and away from each other, and wherein said developer carrying member moves toward said developer feeding member by making contact with said image bearing member.

17. An apparatus according to claim 13, wherein said developer regulating portion is inclined relative to the first and second directions.

18. An apparatus according to claim 13, wherein said developer regulating portion is integral with said developing container.

* * * * *